US005579653A

United States Patent [19]

Sugiyama et al.

[11] Patent Number: 5,579,653

[45] Date of Patent: Dec. 3, 1996

[54] CLOSED-TYPE COMPRESSOR, AND REFRIGERATING UNIT, REFRIGERATOR AND AIR CONDITIONER EACH UTILIZING THE COMPRESSOR

[75] Inventors: Makoto Sugiyama; Hiroyuki Isegawa, both of Fujinomiya, Japan

[73] Assignee: Kabushiki Kaisha Toshiba, Kawasaki, Japan

[21] Appl. No.: 456,305

[22] Filed: Jun. 1, 1995

Related U.S. Application Data

[62] Division of Ser. No. 305,371, Sep. 13, 1994.

[30] Foreign Application Priority Data

Feb. 10, 1994 [JP] Japan ..... 6-16651
Mar. 8, 1994 [JP] Japan ..... 6-37017

[51] Int. Cl.[6] ..... F25B 39/04; F04B 11/00

[52] U.S. Cl. ..... 62/508; 62/114; 310/51; 417/423.7

[58] Field of Search ..... 62/508, 296, 114; 417/423.7; 310/51, 258

[56] References Cited

U.S. PATENT DOCUMENTS 3,154,705 10/1964 Essenburg ..... 310/51
4,959,975 10/1990 Harris ..... 62/508
5,315,200 5/1994 Lemieux ..... 310/51

FOREIGN PATENT DOCUMENTS 0322531 7/1989 European Pat. Off. .
62-11357 3/1987 Japan .
63-162991 7/1988 Japan .

OTHER PUBLICATIONS

*Patent Abstracts of Japan*, vol. 18, No. 127, (M-1569), Mar. 2, 1994 & JP-A-05 312 162, (Hitachi Ltd.), Nov. 22, 1993.
*Patent Abstracts of Japan*, vol. 15, No. 232, (M-1124), Jun. 13, 1991 & JP-03 070 882, (Mitsubishi Electric Corp.), Mar. 26, 1991.
*Patent Abstracts of Japan*, vol. 15, No. 393, (M-1165), Oct. 4, 1991 & JP-A-03 160 167, (Toshiba Corp.), Jul. 10, 1991.
*Patent Abstracts of Japan*, vol. 12, No. 31, (M-663), (2878), Jan. 29, 1988 & JP-A-62 186 090, (Matsushita Refrig. Co.), Aug. 14, 1987.
*Patent Abstracts of Japan*, vol. 12, No. 374, (M-749), (3221), Oct. 6, 1988 & JP-A-63 124 890, (Hitachi Ltd.), May 28, 1988.
*Patent Abstracts of Japan*, vol. 12, No. 485, (M-777), (3332), Dec. 19, 1988 & JP-A-63 205 488, (Hitachi Ltd.), Aug. 24, 1988.

*Primary Examiner*—William E. Wayner
*Attorney, Agent, or Firm*—Foley & Lardner

[57] ABSTRACT

A closed-type compressor comprises a closed casing, an electric motor accommodated in the closed casing and comprising a stator and a rotor, and a compressing machine operatively connected to the motor to be driven thereby. The closed casing comprises a cylindrical body case portion and cover case portions for covering two-side opening portions of the body case portion so as to provide a three-piece structure and a wall thickness of the body case portion is made to be thicker than that of each of the cover case portions. The stator is provided with a stator core and secured in the closed casing in a state where the stator core is stacked and an axial length of the stator is made to be longer than a radius of the stator core. The closed-type compressor of the character described above is applicable to a refrigerating unit, refrigerator or air conditioner.

8 Claims, 15 Drawing Sheets

CLOSED-TYPE COMPRESSOR, AND REFRIGERATING UNIT, REFRIGERATOR AND AIR CONDITIONER EACH UTILIZING THE COMPRESSOR

This application is a division, of application Ser. No. 08/305,371, filed Sep. 13, 1994.

BACKGROUND OF THE INVENTION

1. Industrial Field of the Invention

The present invention relates to a closed-type compressor having a structure taking a countermeasure against noise and vibration, a refrigerating unit, a refrigerator and an air conditioner each using the closed-type compressor.

2. Related Prior Art

A refrigerating unit such as a refrigerating showcase, a refrigerator or an air conditioner includes a refrigerating cycle having a compressor, a condenser, a pressure-reducing unit such as a capillary tube and the like which are disposed sequentially.

The compressor included in the refrigerating cycle, as shown in FIG. 18, has a closed casing 1 in which an electric motor 3 comprising a stator 2*a* and a rotor 2*b* and a compressing machine 5 connected to the motor 3 to be operated through a rotation shaft 4 are accommodated. The closed casing 1 is formed into a two-piece structure comprising a body case portion 6*a* formed into a cylindrical shape having a bottom and a cover case portion 6*b* for covering an opening portion of the body case portion 6*a*.

A refrigerator and an air conditioner, on each of which a compressor of the described type is mounted, are usually used in an ordinary home. Therefore, a great attention must be paid to take a countermeasure against noise as well as improving the performance of the compressor when the compressor is designed and manufactured. In particular, since the compressor acts as a critical noise generating source in the refrigerator and the air conditioner, there is a great desire for developing a compressor of a low noise type taking a countermeasure against noise into consideration.

The compressor has the closed casing in which the motor 3 and the compressing machine 5 are accommodated. The motor 3 and the compressing machine 5 act as sources for generating compressor noise. Noise generated in the motor 3 and compressing machine 5 is transmitted through the closed casing 1 or vibrates the closed casing 1. Therefore, in order to develop a low-noise type compressor, it is the easiest method to thicken the wall of the closed casing 1 and to thereby provide an excellent effect of preventing noise.

The closed casing 1 of the conventional compressor is formed into a two-piece structure comprising the body case portion 6*a* formed into a cylindrical shape having a bottom and the cover case portion 6*b*. The body case portion 6*a* is, by a deep drawing work, formed from a case material, i.e. a work, in the form of a disc plate shape into the cylindrical shape having a bottom. However, since the body case portion 6*a* is formed by the deep drawing work, the wall thickness of the casing and the length (the depth) of the drawn portion are limited to an unsatisfactory degree by the pressing performance of the pressing machine. If the wall of the body case portion 6*a* is intended to be thickened, considerably large pressing force is required and the machining accuracy is limited in thickening the wall of the body case portion 6*a*. Thus, there arises a problem in that a desired wall thickness of the case cannot be realized.

If the wall thickness of the body case portion 6*a* is intended to be thickened simply, a large-size pressing machine is required to perform the deep drawing work with a large machining force. In this case, the quantity of deformation of the work becomes too large, causing problems to arise in that galling takes place between a molding die and the work, breakage occurs due to damage of the work and the minimum wall thickness (the designed specification value) of the work cannot easily be maintained and therefore a satisfactory yield cannot be realized.

Since the refrigerator is usually installed in a room, the compressor noise must be severely prevented. In particular, noise in a low frequency range from 300 Hz to 500 Hz raises a problem of noise uncomfortable to persons and thus there arises a technical requirement to lower the noise in such low frequency range.

The low-frequency noise from the compressor is electromagnetic noise caused from the motor. A motor capable of fully preventing generation of the electromagnetic noise has not been designed yet. Although a program for designing the motor made on the basis of the motor efficiency, the torque and the manufacturing facility is present, no design program for preventing noise is present. Therefore, when a mounting test, in which the manufactured motor is mounted into a closed casing, is performed to examine the motor noise, the specifications, such as the motor coil wire, are changed to take a countermeasure against noise if excessive noise is generated in the motor.

However, the noise prevention means realized by changing the specifications of the motor coil or the like cannot satisfactorily prevent the low frequency noise of the compressor. There has arisen a requirement for a design for a closed-type compressor capable of satisfactorily preventing the low frequency noise.

SUMMARY OF THE INVENTION

A primary object of the present invention is to substantially eliminate defects or drawbacks encountered in the prior art described above and to provide a closed-type compressor of a low noise and low vibration type capable of reducing compressor noise and vibrations, and also provide a refrigerating unit, a refrigerator and an air conditioner each using the closed-type compressor.

Another object of the present invention is to provide a closed-type compressor in which a wall thickness of a body case portion of the closed casing is thickened to improve the case rigidity, and vibrations of a motor and a compressing machine in the closed casing are prevented to improve the compressor performance, and also provide a refrigerating unit, a refrigerator and an air conditioner each using the closed-type compressor.

A further object of the present invention is to provide a closed-type compressor capable of easily and economically molding a body case portion exhibiting improved rigidity and capable of reducing compressor noise and thus exhibiting excellent quiet characteristics, and also provide a refrigerating unit, a refrigerator and an air conditioner each using the closed-type compressor.

A still further object of the present invention is to provide a closed-type compressor capable of lowering noise level over the all frequency range and exhibiting excellent quiet characteristics, and also provide a refrigerating unit, a refrigerator and an air conditioner each using the closed-type compressor.

A still further object of the present invention is to provide a closed-type compressor capable of preventing low-frequency electromagnetic noise of a motor and exhibiting excellent quiet characteristics.

These and other objects can be achieved according to the present invention by providing, in one aspect, a closed-type compressor comprising a closed casing, an electric motor accommodated in the closed casing and comprising a stator and a rotor, and a compressing machine operatively connected to said motor to be operated thereby, wherein the closed casing comprises a cylindrical body case portion and cover case portions for covering two-side opening portions of the body case portion so as to provide a three-piece structure, and a wall thickness of the body case portion is made to be thicker than that of each of the cover case portions.

In preferred embodiments, the body case portion has a seam formed with a rectangular steel plate member which is rolled and joined by means of welding. The body case portion is formed into a cylindrical shape by cutting a steel pipe member so as to provide a predetermined length or by an extrusion molding or drawing process. The body case portion has a wall thickness made to be 1.25 times to 1.4 times a wall thickness of the cover case portion.

The stator has a stator core secured in the closed casing and provided with an outer cut portion and the seam of the body case portion is aligned to the outer cut portion of the stator core. Pipe means such as pipes for refrigerant are disposed in regions except the seam portion of the body case portion. The compressing machine is of a rotary type and is provided with blade means, and the seam portion of the body case portion is formed to a portion opposing to a rear surface of the blade means. The rotary type compressing machine has a rotation shaft which is disposed horizontally and the blade of the compressing machine is immersed in an oil reservoir for lubricating oil formed in a bottom portion of the closed casing.

A compressor support member is disposed in the cover case portion of the closed casing.

A refrigerant pipe is disposed in the cover case portion of the closed casing.

An oil cooler is disposed in the cover case portion of the closed casing.

The stator is, in a stacked state, secured in the closed casing and an axial length of the stator is made to be longer than a radius of the stator core.

The compressing machine has sliding portions to be lubricated and a synthesized oil containing an ester-type oil is used as a lubricating oil for lubricating the sliding portions of the compressing machine.

An HFC refrigerant such as R134a is solely used as a refrigerant, an HFC mixed refrigerant is used as a refrigerant, or an HCFC refrigerant such as R22 is used as a refrigerant to be compressed by the compressing machine. A lubricating oil containing an ester-type oil is used as a lubricating oil for lubricating sliding portions of the compressing machine and an HFC refrigerant such as R134a is used as a refrigerant to be compressed by the compressing machine.

In another aspect, there is provided a closed-type compressor comprising a closed casing, an electric motor accommodated in the closed casing and comprising a stator and a rotor, and a compressing machine operatively connected to the motor to be operated thereby, wherein the stator is provided with a stator core and secured in the closed casing in a state where the stator core is stacked and an axial length of the stator is made to be longer than a radius of the stator core.

In further aspect, there is provided a refrigerating unit, refrigerator, or air conditioner comprising a refrigerating cycle composed by a compressor, a condenser, a pressure-reducing unit and an evaporator operatively connected sequentially, wherein the refrigerating unit, refrigerator or air conditioner includes a closed-type compressor of the characters or structures described above.

According to the closed-type compressor of the present invention of the characters described above, the closed casing is formed into the three-piece structure comprising the cylindrical body case portion and the cover case portions covering the two side openings of the body case portion and the wall thickness of the body case portion is made to be thicker than that of the cover case portions. Therefore, noise transmitted from the motor and the compressing machine in the closed casing can effectively be shielded. Furthermore, the rigidity of the body case portion can be improved, and accordingly, vibrations of the motor and the compressing machine accommodated in the closed casing can be reduced. Thus, a low-noise and small-vibration type closed-type compressor can be provided.

Since the closed casing of the compressor is formed into the three-piece structure, a deep drawing work is not required to form the two-side cover case portions and thus the quantity of deformation can be reduced. Therefore, it can easily be formed by a press work and, accordingly, damage of the cover case portion, such as galling or breakage, can effectively be prevented and therefore the yield can be improved.

The closed-type compressor employs the rolling work so that the body case portion of the closed casing is enabled to be formed by using a rectangular steel plate and therefore the deep drawing work can be omitted. Therefore, the body case portion having a thick wall can easily and economically be formed and the rigidity of the body case portion can be hence improved.

The closed-type compressor employs a cutting working of a steel pipe to have a predetermined length or the extrusion molding or drawing so that the cylindrical body case portion is formed easily, the deep drawing work is omitted and therefore the body case portion having a thick wall is formed easily with low cost required.

The wall thickness of the body case portion is about 1.25 times to 1.4 times that of the cover case portion. Therefore, compressor noise can be lowered to a level practical for a refrigerator, a refrigerating unit or an air conditioner.

The position of the seam of the body case portion is aligned to the outer cut portion of the stator core of the motor accommodated in the closed case. Therefore, if a satisfactory accuracy of the inner diameter of the seam portion of the body case portion cannot be realized by the rolling work, the stator core can easily and smoothly be press-fitted. Therefore, breakage of the seam portion of the body case portion can be prevented and the reliability can be hence improved thereof.

The refrigerant pipes are disposed on the outside of the seam portion of the body case portion. Therefore, the refrigerant pipes, such as the suction pipe, the discharge pipe and the cooling pipe, are not disposed in the seam portion of the body case portion and therefore no pipe holes are formed in the welded portion of the seam. As a result, breakage of the welded portion of the seam can effectively be prevented when the pipe holes are formed. Since the pipe holes can be, except the seam portion, formed in regions in which no residual strain remains, the accuracy in forming the holes can be improved.

The seam portion of the body case portion is positioned to oppose the rear side of the blade of the rotary-type compressing machine. Therefore, refrigerant pipes, such as the suction pipe and the cooling pipe, are not disposed in the seam portion of the body case portion. Thus, the breakage of the welded portion in the seam portion of the body case portion can effectively be prevented when the pipe holes are formed.

The seam portion of the body case portion is formed in the bottom portion of the closed case, the rotation shaft of the rotary-type compressing machine is disposed horizontally and the blade of the compressing machine is immersed in the lubricating oil reservoir in the bottom portion of the case. Therefore, the welded portion, which is the seam portion of the body case portion, can be covered, and accordingly, the position at which the plate, such as a name plate, is attached, can be used widely. Since neither projection nor peripheral sputters are present at the position at which the name plate or the like is attached, the name plate or the like can easily be attached or applied.

Furthermore, no refrigerant pipe is disposed in the seam portion of the body case portion, and the seam portion opposes the rear side of the blade of the rotary-type compressing machine and also opposes the outer cut portion of the stator core of the motor. Therefore, the compressing machine and the stator core can smoothly be inserted into the closed case. Thus, breakage of the welded portion, which is the seam portion of the body case portion, can effectively be prevented when the stator core is inserted.

The compressor support member or the refrigerant pipe is disposed in the cover case portion of the closed case. Therefore, the case rigidity of the cover case portion can be improved equivalently to the body case portion while eliminating the necessity of employing the thick wall structure as employed by the body case portion. Therefore, the work for forming the cover case portion can be facilitated.

Since the oil cooler is disposed in the cover case portion of the closed case, the heat exchanging operation to and from the outside of the closed case can effectively be obtained. Thus, overheating of the compressor can effectively be prevented.

Since the closed-type compressor comprises the motor accommodated in the closed casing in which the axial length of the stator to be secured in the closed casing in a stacked state is made to be longer than the radius dimension of the stator core, the noise pressure level over the entire frequency range can be lowered. Therefore, the compressor noise can effectively be lowered.

Since the closed-type compressor employs the synthesized oil containing the ester-type oil as the lubricating oil, excellent heat resistance can be obtained. Although the ester-type oil or the like involves a high noise transmission ratio as compared with that of the mineral oil and therefore the noise level over the entire frequency range is raised, the closed-type compressor employing the closed case structure enables practically quiet characteristics can be obtained even if the lubricating oil containing the ester-type oil is used.

The closed-type compressor may use the HFC (hydrofluorocarbon) refrigerant such as R134a in a single form or a mixed HFC refrigerant or the HCFC (hydrochlorofluorocarbon) such as R22. For example, the HFC refrigerant involves a noise transmission ratio higher than that of the conventional CFC (chlorofluorocarbon) refrigerant. However, the closed-type compressor according to the present invention employs the closed case structure so that practically quiet characteristics can be obtained even if the HFC refrigerant or the like is used.

The closed-type compressor is able to prevent raising of the noise level even if the lubricating oil containing the ester-type oil and the HFC refrigerant, which involve a higher noise transmission ratio as compared with the conventional mineral oil and the CFC refrigerant, are used. Thus, practically quiet characteristics can be obtained. Further satisfactory quiet characteristics of a lower noise level can be obtained in a case where the HCFC refrigerant is used.

The closed-type compressor has the arrangement that thickness (the axial length) of the stacked core forming the stator of the motor is made to be thicker than the radius of the stator core. Therefore, the noisy electromagnetic sound of the motor in a low frequency range from 300 Hz to 500 Hz can be lowered.

The refrigerating unit utilizing the closed-type compressor of the characters described above enables noise to be lowered satisfactorily without particularly improving the noise shielding structure of the machine chamber of the refrigerating unit. Accordingly, the heat radiating effect cannot be affected adversely and a satisfactory countermeasure of the compressor against overheating can be realized.

The refrigerator utilizing the closed-type compressor of the characters described above is able to satisfactorily lower noise without particularly improving the noise shielding structure of the machine chamber of the refrigerator. Further, the heat radiating effect of the compressor is not affected adversely. Therefore, a satisfactory countermeasure of the compressor against overheating can be realized.

The air conditioner utilizing the closed-type compressor of the characters described above can eliminate the necessity of improving the noise shielding structure of the compressor.

If an improved noise shielding structure is employed in the refrigerating unit, the refrigerator or the air conditioner, a further improved noise prevention effect can be realized. In this case, a countermeasure against overheating of the compressor is required.

The nature and further features of the present invention will be made more clear hereunder from the descriptions with reference to the accompanying drawings.

DESCRIPTION OF THE PREFERRED EMBODIMENTS

A preferred embodiment of the present invention will now be described with reference to the drawings.

Figure 1:
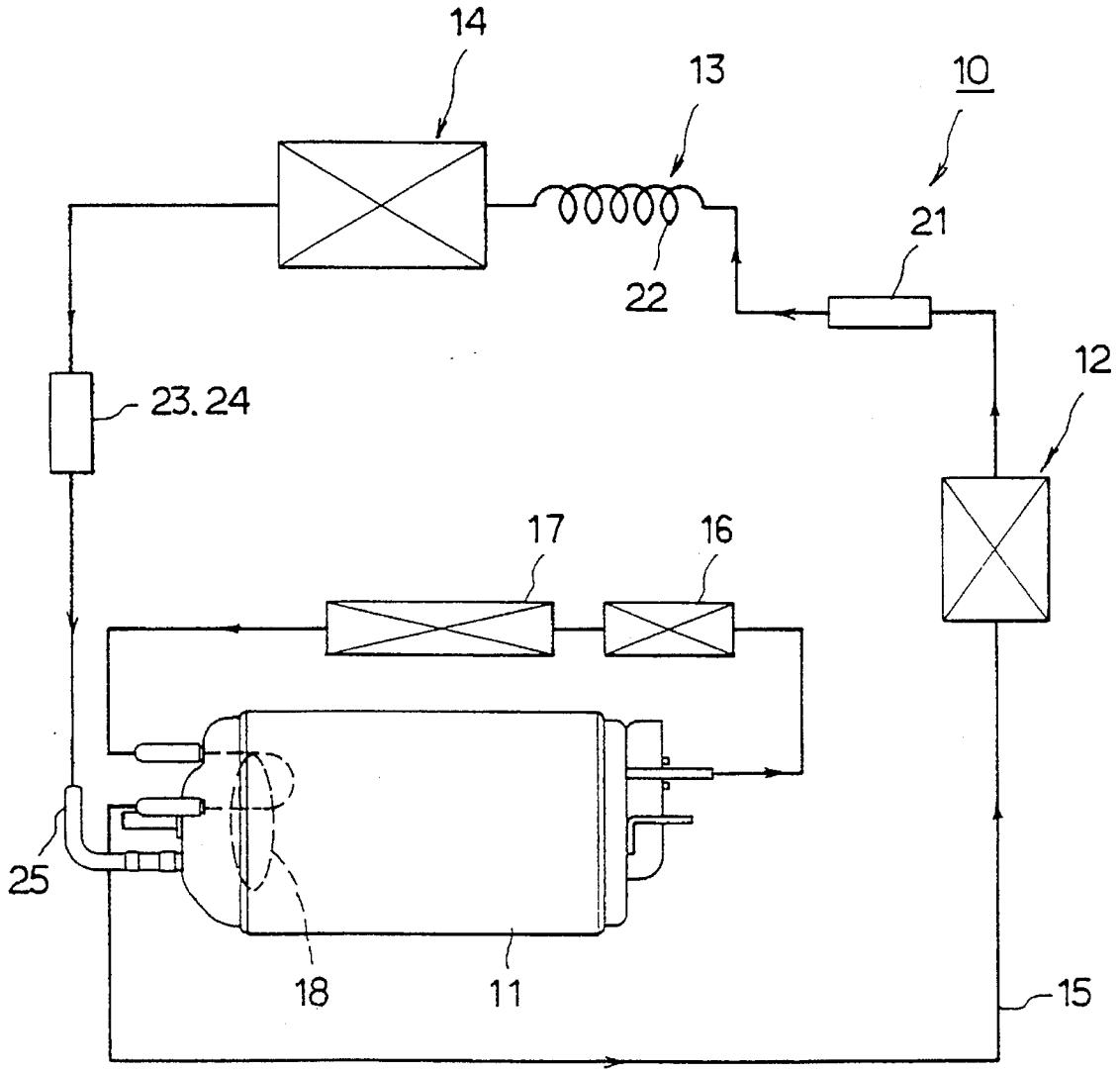
FIG. 1 is a diagram showing a refrigerant cycle of a refrigerator having a closed-type compressor according to the present invention.
Figure 2:
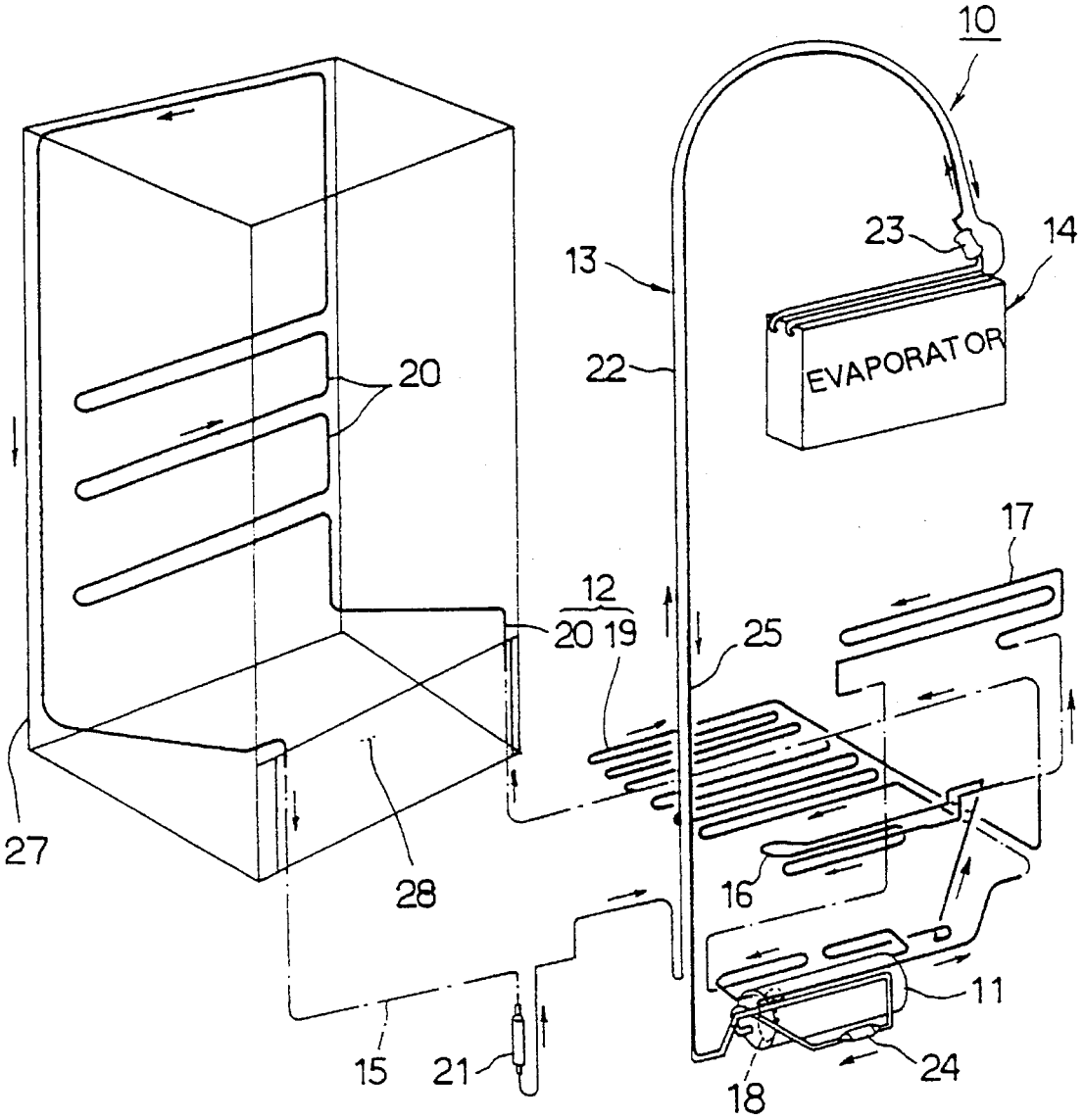
FIG. 2 is a perspective view schematically showing the refrigerating cycle of the refrigerator shown in FIG. 1.

FIGS. 1 and 2 show one embodiment in which a closed-type compressor according to the present invention is adapted to a refrigerating cycle 10 of a refrigerator.

The refrigerating cycle 10 basically constitutes a closed refrigerant circulating circuit formed by sequentially connecting a closed-type compressor 11, a condenser 12, a pressure reducing unit 13 and an evaporator 14 by using refrigerant pipes 15.

Specifically, the refrigerating cycle 10 is, as shown in FIG. 2, sequentially connected to a main condenser 19 and a clean pipe 20 which form the condenser 12 through the closed-type compressor 11, an evaporating pipe 16, a sub-condenser 17 and an oil cooler 18. Furthermore, the refrigerating cycle is connected to an evaporator 14 through a drier 21 and the pressure reducing unit 13 comprising a capillary tube 22. The evaporator 14 is connected to the suction side of the closed-type compressor 11 by a suction pipe 25 through an accumulator 23 and a muffler 24. Thus the closed refrigerating cycle circulating circuit is constituted.

The closed-type compressor 11 is, as shown in FIG. 2, placed in a machine chamber 28 formed in the lower portion of the rear side of a body casing 27 of the refrigerator. The compressor 11 compresses a refrigerant for a compressor which acts to raise the temperature and the pressure of the refrigerant so as to discharge it to the refrigerating cycle 10. As the refrigerant for a compressor, 1,1,1,2-tetrafluoroethane (hereinafter called "refrigerant R134a") is used which is a HFC (hydrofluorocarbon) refrigerant that does not destroy the ozone layer. The refrigerant R134a has refrigerating characteristics like a refrigerant R22 which is an HCFC type refrigerant.

Figure 3:
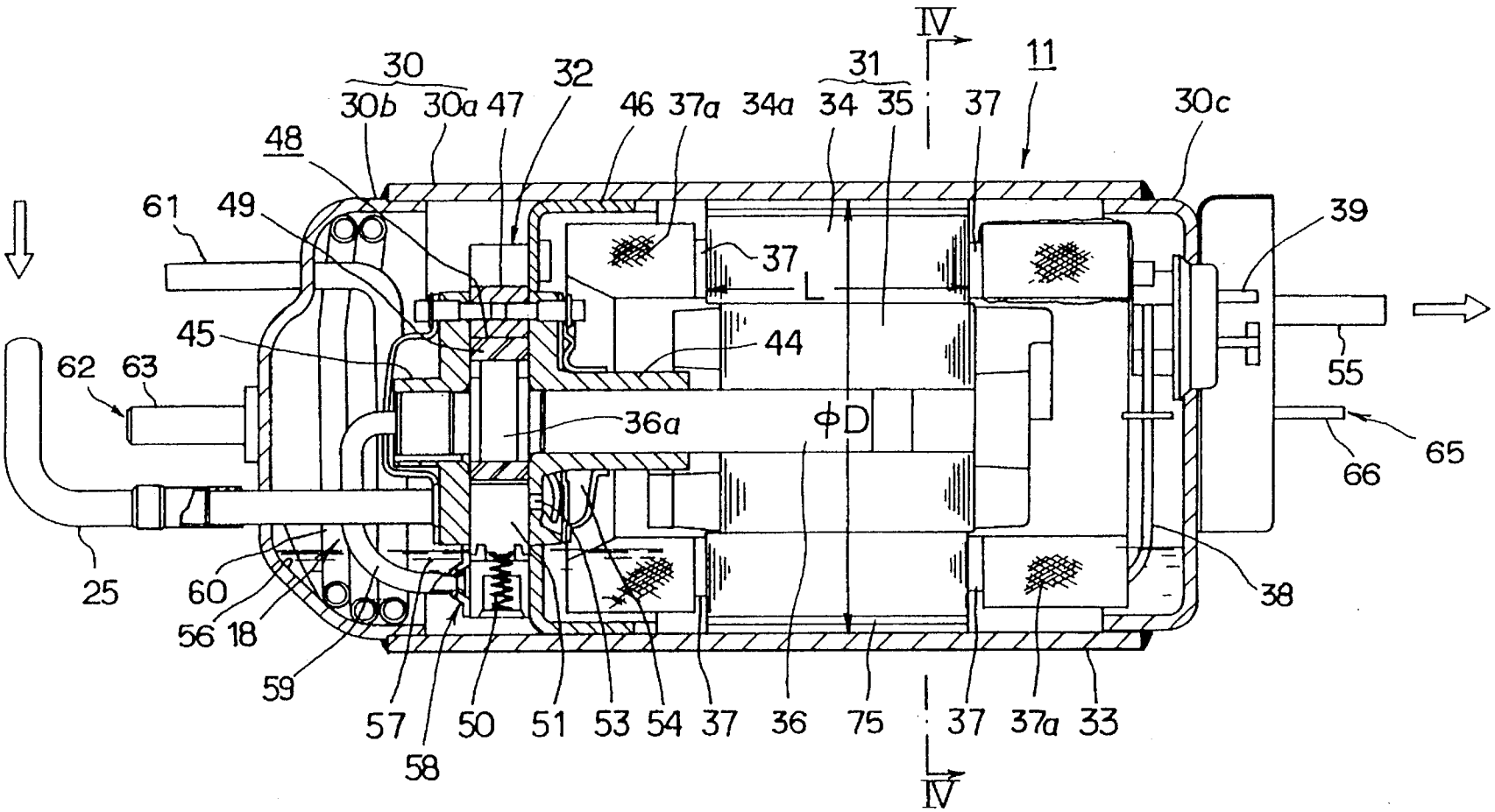
FIG. 3 is a vertical cross sectional view showing a first embodiment of the closed-type compressor according to the present invention.

The closed-type compressor 11 using R134a, which is the HFC refrigerant, is constituted as shown in FIG. 3.

The closed-type compressor 11 is, for example, a horizontal rotary compressor arranged such that a motor 31 and a rotary-type compressing machine 32 to be driven by the motor 31 are accommodated in a closed casing 30.

The closed casing 30 is formed into three-piece structure comprising a cylindrical body case portion 30*a* and cover case portions 30*b* and 30*c* disposed on the two sides of the body case portion 30*a* to cover opening portions. The closed casing 30 is formed into the closed structure by integrating the body case portion 30*a* and the cover case portions 30*b* and 30*c* by welding their contact portions.

Figure 4:
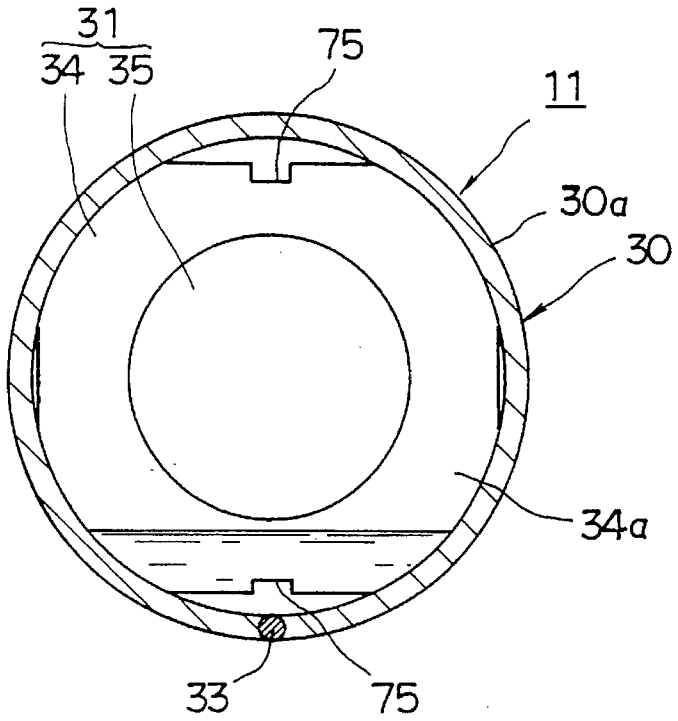
FIG. 4 is a cross sectional view taken along line IV—IV shown in FIG. 3.

The body case portion 30*a* of the closed casing 30 is, as shown in FIG. 4, formed by rolling a rectangular steel plate and by joining a joint portion 33 through welding process to form a seam. Since the body case portion 30*a* is formed by the rolling work, the conventional deep drawing work can be omitted and thus it can be manufactured easily and economically. The body case portion 30*a* is formed to have walls thicker than those of the cover case portions 30*b* and 30*c* so that the rigidity of the body case portion 30*a* is improved to serve as a case.

The motor 31 has a stator 34 to be press-fit into the closed casing 30 and a rotor 35 disposed rotatively around the stator 34. A rotation shaft 36 is inserted into the rotor 35. The stator 34 is formed by stacked plate-like stator cores 34*a* which are press-fitted or shrinkage-fitted into the body case portion 30*a* of the closed casing 30. Furthermore, coil end portions 37*a* of a stator coil wire 37 disposed around the stator 34 are bound to be connected to a power source terminal 39 through a lead wire 38. The power source terminal 39 is attached to the cover case portion 30*c* of the closed casing 30.

The rotation shaft 36 to be inserted into the rotor 35 of the motor 31 is disposed horizontally and rotatively supported by a main bearing 44 and a sub-bearing 45 of the rotary-type compressing machine 32. The main bearing 44 is attached to a support frame 46 secured in the closed casing 30. The main bearing 44, a cylinder block 47 serving as a cylinder and the sub-bearing 45 form an inside cylinder chamber 48, in which a piston roller 49 is accommodated in the cylinder chamber 48.

The piston roller 49 is attached to a crank portion 36*a* of the rotation shaft 36 so as to be eccentrically rotated in the cylinder chamber 48 when the rotation shaft 36 is rotated. A blade 51 pressed by a spring 50 comes in contact with the piston roller 49 and presses the same from outside so that the cylinder chamber 48 is sectioned into a suction portion and a discharge portion. When the piston roller 49 is eccentrically rotated, the HFC refrigerant allowed to pass through the suction pipe 25 and sucked into the cylinder chamber 48 is compressed so that the temperature and the pressure thereof are raised. Then, the HFC refrigerant is discharged from the discharge portion into a discharge chamber 54 through a discharge port 53.

The HFC refrigerant discharged into the discharge chamber 54 is then guided into the closed casing 30, the HFC refrigerant being then allowed to pass through a discharge pipe 55 serving as a pipe for the refrigerant so as to be moved toward the condenser 12.

An oil reservoir 56 is formed in the bottom portion of the closed casing 30, the oil reservoir 56 reserving lubricating oil (refrigerator oil) 57 for lubricating sliding portions of the compressing machine 32. The reserved lubricating oil 57 is allowed to pass through an oil supply pipe 59 and supplied to sliding portions, such as the bearing portion of the rotation shaft 36 by an oil pump 58 to thereby lubricate the sliding portions. The oil pump 58 sucks the reserved lubricating oil 57 into the oil supply pipe 59 in cooperation with the forward and rearward movements of the blade 51 so as to supply the lubricating oil 57 to the sliding portions.

The lubricating oil 57 reserved in the closed casing 30 is cooled by the oil cooler 18 to maintain the lubricating performance of the lubricating oil 57. The oil cooler 18 comprises a heat exchanging pipe 60 wound multiple times in an annular form to cool the lubricating oil 57 and the refrigerant in the closed casing 30, the heat exchanging pipe 60 being disposed in the cover case portion **30*b* in the closed casing 30**.

By disposing the oil cooler 18 as described above, since the oil cooler 18 is positioned in the cover case portion **30*b*, in which heat can easily be transmitted as compared with the body case portion 30*a* because the wall thickness of the cover case portion 30*b* is thinner than that of the body case portion 30*a*, an effect of exchanging heat with the air on the outside of the closed casing 30 can be obtained efficiently. Thus, the effects of the lubricating oil and the refrigerant in the closed casing 30** can be improved.

Since the closed-type compressor shown in FIG. 3 is the horizontal type compressor, the cooling effect obtainable from the oil cooler 18 acts on both of the lubricating oil and the refrigerant. If a closed-type compressor is disposed vertically such that the oil cooler is disposed at the lower end of the closed casing, the cooling effect satisfactorily acts on the overall body of the lubricating oil.

Although the lubricating oil 57 for lubricating the sliding portions in the closed-type compressor 11 may be a mineral oil (a naphthenic oil), an ester-type oil is used, which exhibits excellent heat resistance, in order to prevent deterioration and carbonization of the lubricating oil.

By employing the ester-type oil as the lubricating oil 57, excellent heat resistance is obtained, and the deterioration and carbonization of the lubricating oil 57 can effectively be prevented with the assistance of the cooling effect of the oil cooler 18. Therefore deterioration in the lubricating performance of the lubricating oil 57 can effectively be prevented.

The lubricating oil 57 is able to efficiently lubricate the bearing surfaces of the rotary-type compressing machine 32 and the sliding surface between the piston roller 49 and the blade 51. Thus, the performance of the closed-type compressor 11 can be improved and the reliability thereof can be maintained satisfactorily.

The operations of the closed-type compressor 11 and the refrigerant cycle will be described hereunder.

When electric power is supplied to the motor 31 of the closed-type compressor 11, the motor 31 is rotated and therefore the rotor 35 is rotated. When the rotor 35 is rotated, the rotation shaft 36 is rotated integrally with the rotor 35. Thus, the piston roller 49 attached to the crank portion **36*a* of the rotation shaft 36 is eccentrically rotated in the cylinder chamber 48. As a result, the rotary-type compressing machine 32** is operated.

The HFC refrigerant passing through the suction pipe 25 and guided to the suction side of the cylinder chamber 48 due to the eccentric rotations of the piston roller 49 is compressed in the cylinder chamber 48. As a result, the temperature and pressure of the HFC refrigerant are raised and then the HFC refrigerant is discharged from the discharge portion of the cylinder chamber 48 into the closed casing 30 through the discharge chamber 54. The HFC refrigerant discharged into the closed casing 30 is, through the discharge pipe 55, sent to the evaporating pipe 16 in the refrigerant cycle 10. In the evaporating pipe 16, drain water reserved in the evaporating tray is evaporated.

The discharged HFC refrigerant caused its drain water to evaporate in the evaporating pipe 16 is then guided to the sub-condenser 17 so that its heat is radiated and the HFC refrigerant is cooled. Then, the HFC refrigerant is guided to the oil cooler 18 to cool the lubricating oil 57 reserved in the closed casing 30. As a result, deterioration of the lubricating oil 57 is prevented and the lubricating performance is maintained. The oil cooler 18 prevents the overheat of the portion in the closed casing 30.

The HFC refrigerant discharged from the oil cooler 18 is then sent to the condenser 12 so that the heat of the HFC refrigerant is radiated in the main condenser 19 and the clean pipe 20. The clean pipe 20 is connected to the condenser 19 in series to have a function as a condenser which is capable of preventing dew condensation occurring on the front, surface of the body of the refrigerator due to the difference between the temperature in the refrigerator and the room temperature.

The HFC refrigerant passing through the clean pipe 20 is dried in the drier 21, and then it is guided to the capillary tube 22 serving as the pressure reducing unit 13 so that the pressure of the HFC refrigerant is reduced to be adiabatically expanded. The pressure reducing unit 13 may be an expanding valve in place of the capillary tube 22.

The HFC refrigerant, the pressure of which has been reduced in the capillary tube 22, is then guided to the evaporator 14. The HFC refrigerant derives heat from the atmosphere in the evaporator 14 so as to be evaporated. The gas component and the liquid component of the HFC refrigerant evaporated in the evaporator 14 are separated from each other in the accumulator 23. The gas component is guided to the suction pipe 25. The liquid component of the HFC refrigerant is stored in the accumulator 23.

The HFC refrigerant gas guided to the suction pipe 25 is subjected to noise absorption in the muffler 24 disposed as occasion demands. Then, the HFC refrigerant is sucked into the suction portion of the closed-type compressor 11 and then is again compressed in the next compressor 11 for the next refrigerating cycle 10.

The closed-type compressor 11 has the closed casing 30 which is, as shown in FIG. 3, formed into the three-piece structure comprising the cylindrical body case portion **30*a* and the cover case portions 30*b* and 30*c* disposed on the two sides of the body case portion 30*a* to cover the opening portions. Since the body case portion 30*a* is formed by rolling the rectangular steel plate, the wall thickness of the body case portion 30*a* can easily be changed by selecting the material of the rectangular steel plate. Therefore, a thick structure can be formed. Although the body case portion 30***a* is formed into the structure having thick walls, the employment of the rolling process enables the deep drawing work to be omitted. Therefore, the molding work can be easily and economically completed. The molding process enables a cylindrical structure to be formed easily. Therefore, the body case portion 30*a* is easily enabled to be formed with a designed wall thickness.

It is preferable that the wall thickness of the body case portion 30*a* is 1.25 times to 1.4 times the wall thickness of each of the cover case portions 30*b* and 30*c*. The rigidity of the casing can be improved by causing the body case portion 30*a* to have a thick wall (a thick plate of the casing). Therefore, the level of noise from the motor 31 and the rotary-type compressing machine 32 can be lowered. Vibrations of the closed-type compressor 11 and the refrigerator can be prevented, thus lowering the noise of the compressor rotary-type compressing machine 32 to a practically allowable level over the entire frequency band.

By causing the body case portion 30*a* to have a thick wall, noise transmitted from the motor 31 and the rotary-type compressing machine 32, which may constitute a source of generating vibrations, can be shielded satisfactorily as compared with the conventional structure.

It is not necessary, for the cover case portions 30*b* and 30*c* hermetically secured onto the two sides of the body case portion 30*a* by welding their outer surfaces, which are in contact with one another, to have a thick wall structure as compared with the body case portion 30*a*. The reason for this is that the major portion of noise transmitted from the motor 31 and the rotary-type compressing machine 32 can easily be discharged through the body case portion 30*a*. Therefore, the arrangement that the body case portion 30*a* has a thick wall structure enables effective noise prevention to be realized.

Even if the thick wall structure is not employed in each of the cover case portions 30*b* and 30*c*, the suction pipe 25, the cooling pipe 61 and a support pin (stud pin) 63 serving as a case support member forming a support unit 62 are attached to the cover case portion 30*b*, thus maintaining the satisfactory rigidity thereof. The cover case portion 30*c* is provided with the refrigerant pipes, such as the discharge pipe 55, and a support metal 66 serving as a case support member forming a support unit 65 attached thereto, thus also maintaining the satisfactory rigidity thereof.

Figure 5:
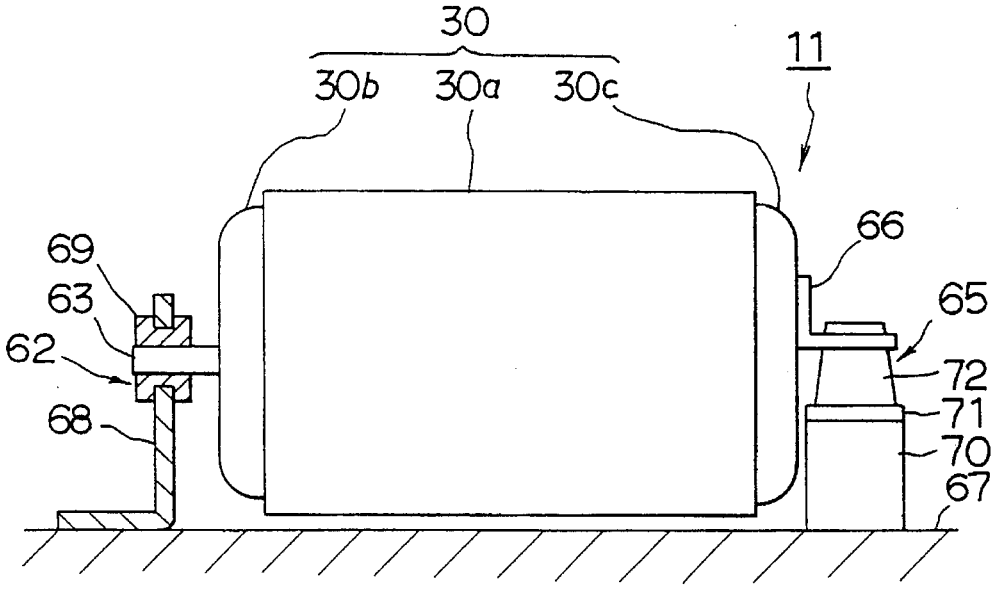
FIG. 5 is a diagram schematically showing a mounting and support structure of the closed-type compressor shown in FIG. 3.
Figure 6:
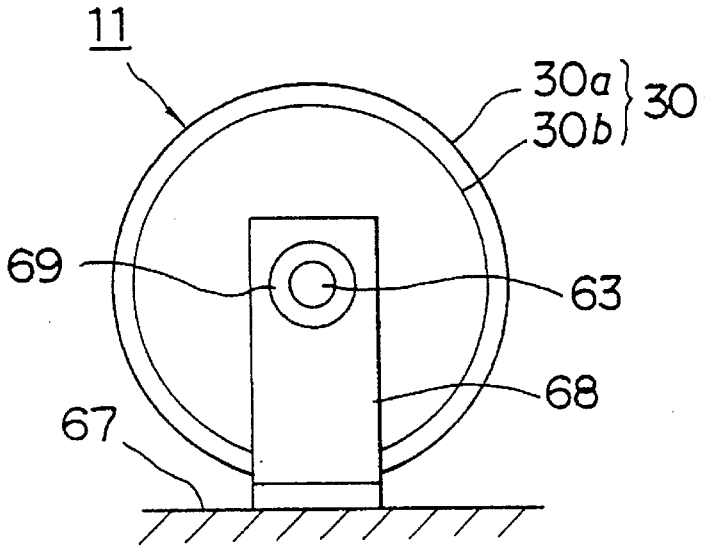
FIG. 6 is a side view schematically showing the mounting and support structure as viewed from the left in FIG. 5.
Figure 7:
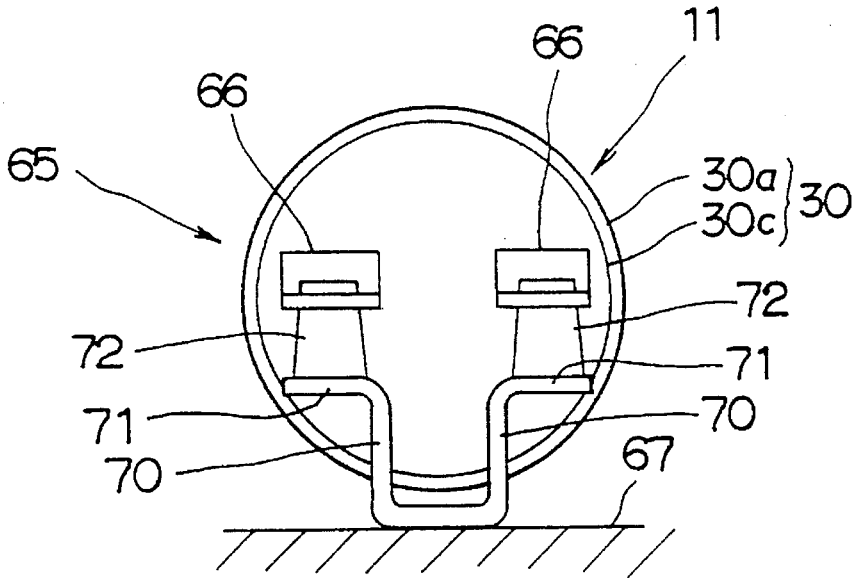
FIG. 7 is a side view schematically showing the mounting and support structure as viewed from the right in FIG. 5.

As described above, the closed casing 30 of the closed-type compressor 11 is formed into an antivibration structure disposed in the machine chamber 28 formed in the lower portion on the rear side of the refrigerator, and the closed casing 30 is supported at three points such that the two sides of the closed casing 30 are supported by the support units 62 and 65 as shown in FIGS. 5 to 7.

The support unit 62 is formed into a one-point support structure so that its support leg 68 is placed on a base 67 of the machine chamber 28, an antivibration member 69 is disposed in the upper portion of the support leg 68, and the antivibration member 69 supports a support pin 63.

The other support unit 65 is formed into a two-point support structure arranged such that an antivibration member 72 is placed on each of a pair of support flanges 71 of support legs 70 on the base 67. A support metal 66 is placed on the antivibration member 72 so that the closed casing 30 is supported on the base 67. Three support points of the two support units 62 and 65 form a plane in which the axial line of the rotational shaft 36 is included.

The seam portion, which is the joint portion 33 of the body case portion 30*a* of the closed casing 30, is brought into the bottom portion of the closed casing 30 as shown in FIG. 4. By forming the portion for welding the seam in the bottom portion of the body case portion 30*a*, the exposure of the seam can be prevented so that the appearance of the closed-type compressor 11 is improved. In addition, a plate, for example, a name plate, can be attached or applied to a wide area except the seam portion. Therefore, a wide area is allowed to use to attach a name plate or the like. Furthermore, neither sputters nor projections in the welding portion forming the seam are present in that portion, to which the name plate or the like is attached. Therefore, the name plate or the like can easily and freely be attached or applied.

By disposing the refrigerant pipes, such as the suction pipe 25, the discharge pipe 55 and the cooling pipe 61 in the cover case portions 30*b* and 30*c*, it does not become necessary to attach the refrigerant pipes to the seam portion of the body case portion 30*a*. Furthermore, by disposing the refrigerant pipes 25, 55 and 61 in regions except the seam portion of the body case portion 30*a*, breakage of the welding portion of the seam can be prevented when holes for the pipes are drilled. Since the holes for the pipes can be formed in the regions except, for example, the seam portion in which residual strain remains, the accuracy for forming the holes for the pipes can be improved.

Still furthermore, since the seam portion of the body case portion 30*a* is formed in the bottom portion of the closed casing 30 at a position at which it faces the rear side of the blade of the rotary-type compressing machine 32, the rotary-type compressing machine 32 and its support portion can be accommodated in the portions except the seam portion of the body case portion 30*a*. Since it is not necessary to dispose the refrigerant pipes in the seam portion of the body case portion 30*a*, the breakage of the welded seam portion of the body case portion 30*a*, occurring when the holes for the pipes are drilled, can be prevented.

The stator 34 of the motor 31 to be accommodated in the closed casing 30 is disposed as shown in FIG. 4, in which an outer cut portion 75 of the stator core 34*a* of the stator 34 is aligned to the joint portion 33 of the body case portion 30*a*. As a result, even if the accuracy of the inner diameter of the body case portion 30*a* formed by the rolling work is not satisfactory, the press fitting or the shrinkage fitting of the stator core 34*a* into the body case portion 30*a* can be performed easily and smoothly. Since the stator core 34*a* does not come in contact with the joint portion 33 and therefore, damage of the joint portion 33 can be prevented at the time of the press fitting or the shrinkage fitting, breakage of the joint portion 33 of the body case portion 30*a* can be prevented, and thus, improving the reliability.

Since no refrigerant pipe is disposed in the joint portion 33 of the body case portion 30*a* and the joint portion 33 opposes the rear side of the blade of the rotary-type compressing machine 32, and furthermore it opposes the outer cut portion 75 of the stator core 34*a* of the motor 31, the insertion of the compressing machine 32 and the stator core 34*a* into the closed casing 30 can be done smoothly. Therefore, breakage of the welded portion, which is the joint portion of the body case portion 30*a*, can effectively be prevented at the time of inserting the stator core.

On the other hand, since the axial length of the stator 34 to be press-fitted or shrinkage-fitted into the closed casing 30 is made to be longer than the radial size of the stator core, low-frequency noise of 300 Hz to 500 Hz can be reduced.

The mechanism for generating the electromagnetic noise from the motor 31 causes from mutual absorption of the stator core 34*a* and the rotator core occurring due to basic magnetic flux and harmonic flux in the air gap between the stator 34 and the rotor 35, and the absorbing force is periodically generated by the alternating field. Polygonal deformation vibrations are generated in the stator core 34 by the change in the absorbing force and thus the electromagnetic noise is generated.

The electromagnetic noise is generated by low frequency vibrations from 300 Hz to 500 Hz. In order to reduce the electromagnetic noise, it is required (a) to reduce the absorbing force in the air gap, (b) to form the polygonal deformation into a circular shape as much as possible, and (c) to reduce vibrations of the stator core 34.

The requirements (a) and (b) can be satisfied by making the specifications for the wire (main wire and sub-wire) to be wound around the motor 31 to be adequate, by uniforming the air gap and by widening the same. However, the motor efficiency and the performance of the motor are sacrificed. In order to maintain the performance of the motor, the requirements (a) and (b) may have to be somewhat compromised.

The closed-type compressor 11 is arranged in such a way that the content of the requirement (c) to reduce vibrations of the stator core 34*a* is considered and the length L (the axial length of the stator 34) of the stacked stator core 34*a* is maintained by a minimum degree to restrict the vibrations of the stator core 34*a*.

The closed-type compressor 11 is, as shown in FIG. 3, arranged in such a way that the length L (the axial length of the stator 34) of the stacked stator core 34*a* forming the stator 34 of the motor 31 is made such that the ratio of the stacked length L with respect to the outer diameter Φ D of the stator core 34*a* is made to be Φ D/2 or more of the radius of the stator core 34*a* to restrict the vibrations of the stator core 34*a*.

The closed-type compressor 11 is able to optimize the relationship between the saturation of the magnetization of the stator core 34*a* and the quantity of vibrations of the same, that is, the area of the stator core. In other words, the relationship between the vibration energy acting on the stator core 34*a* and the rigidity, i.e. the weight, of the stator core is optimized. If the motors 31 capable of generating the same motor torque, i.e. the vibration energy, are considered, the thicker the thickness L of the stacked stator core 34*a* is, the more the vibrations of the stator core 34*a* can be restricted. The thickness of the stacked stator core 34*a* is determined on the basis of the relationship among the performance of the motor, noise and the cost.

Figure 8:
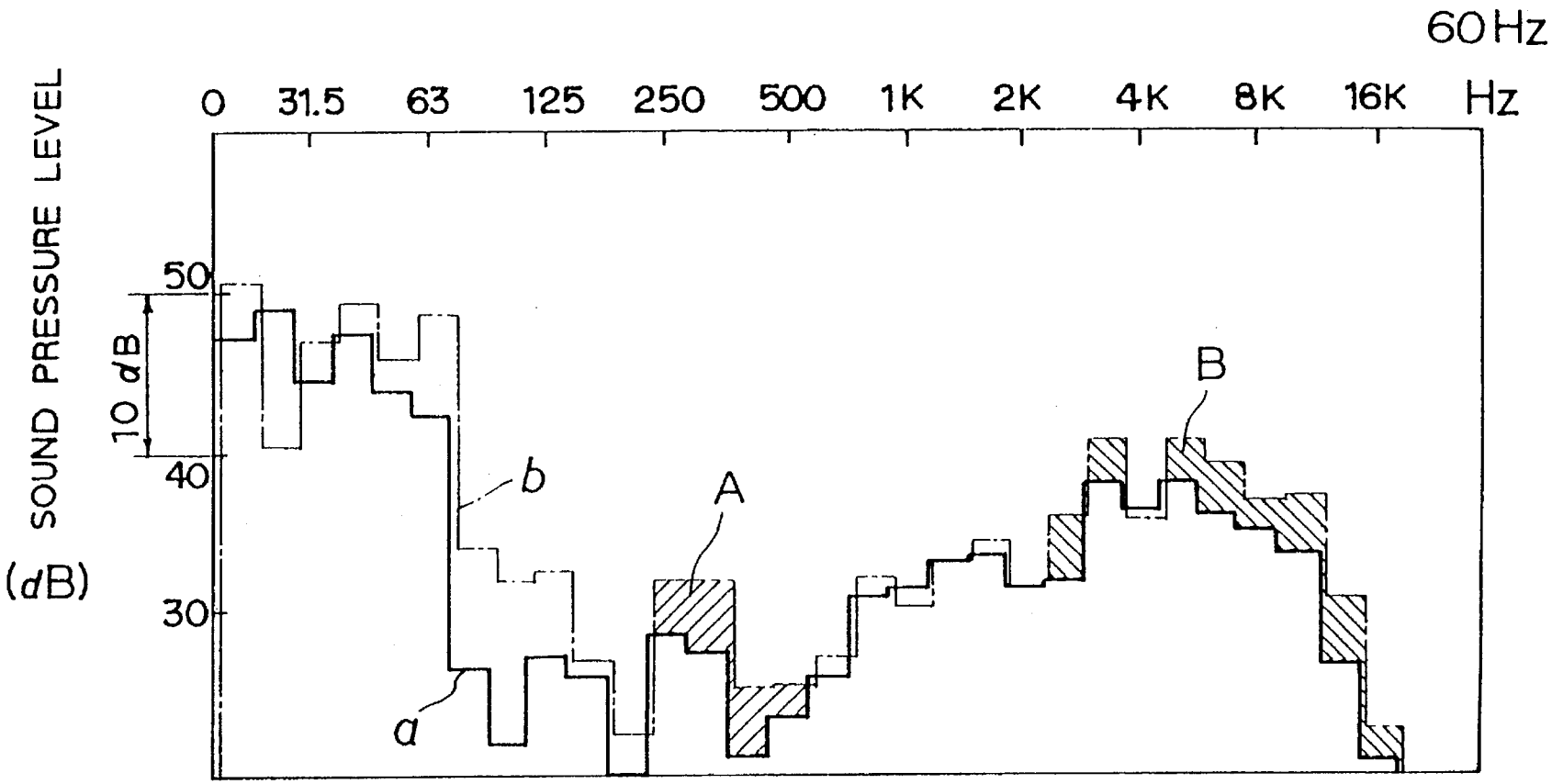
FIG. 8 is a graph showing results of comparison between a sound pressure level (compressor noise) of the closed-type compressor of a three-piece structure according to the present invention and a sound pressure level of a conventional two-piece structure closed-type compressor.

FIG. 8 shows results of an analysis of compressor noise obtained from a comparison between the closed-type compressor according to the present invention of the structure described above and represented by continuous line a and a conventional closed-type compressor represented by dashed line b.

Referring to FIG. 8, hatched region A is a region in which compressor noise of the motor 31 is reduced, while another hatched region B is a region in which compressor noise of the compressing machine 32 is reduced. It was found that the closed-type compressor 11 is able to reduce electromagnetic noise ranging from 300 Hz to 500 Hz caused from the motor 31 and compressor noise caused from the compressing machine 32.

The closed-type compressor 11 is able to reduce compressor noise in substantially all of frequency range and thus an excellent low-noise type compressor can be realized. The vibrations of the compressor can be reduced by thickening the wall of the body case portion 30*a* of the closed casing 30, and therefore, a low-vibration type compressor can be provided.

For the relationship among the outer diameter, the stacked thickness L of the stator core 34*a* of the stator 34 of the motor and noise (the peak frequency from 300 Hz to 500 Hz) in a frequency range from 300 Hz to 500 Hz, the following experimental data was obtained.

TABLE 1

| L/ΦD | Noise (dB) |
|---|---|
| 0.45 | 45 to 50 |
| 0.50 | 40 to 45 |
| 0.60 | 35 to 40 |

As can be understood from the Table 1, the noises of and from the motor 31 become intensified in proportion to the increase in the outer diameter Φ D of the stator and the stacked thickness (the axial length of the stator) L of the stator core 34*a*. Therefore, the low frequency noise caused from the motor 31 can be reduced by making the axial length L of the stator 34 to be longer than a predetermined length, for example, Φ D/2 or longer of the stator core 34*a*.

An example, in which the refrigerant for the closed-type compressor 11 is R134a, which is the HFC refrigerant, and the lubricating oil is ester-type oil, has been described.

Figure 9:
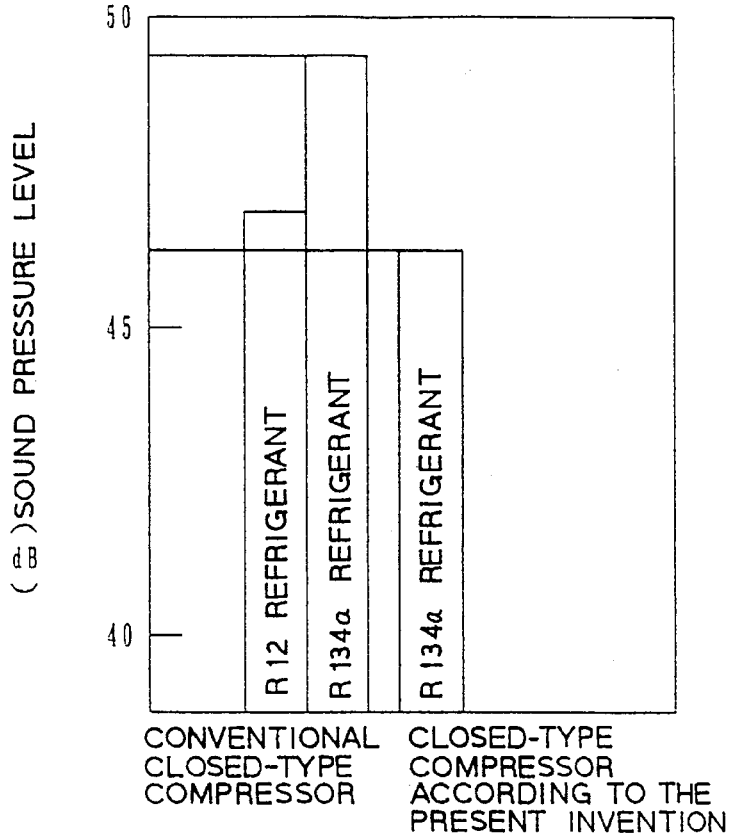
FIG. 9 is a graph showing results of comparison between average noise level in a case where refrigerant R134a is, as a HFC refrigerant, used in the closed-type compressor according to the present invention and average noise level in a case where refrigerant R12 and refrigerant R134a are used in the conventional closed-type compressor.

The refrigerant R134a, which is an HFC refrigerant, involves a noise transmission efficiency higher than that of refrigerant R12 which is a CFC refrigerant. Therefore, if the refrigerant R134a is used in the conventional closed-type compressor of the two-piece structure, compressor noise of the compressor using the refrigerant R134a becomes intensified as shown in FIG. 9.

However, the closed-type compressor 11 is formed into the three-piece structure and employs the closed-case structure in which the wall thickness of the body case portion 30*a* of the closed casing 30 is thicker than that of each of the cover case portions 30*b* and 30*c*. Therefore, even if the refrigerant R134a, which is the HFC refrigerant, is used, the compressor noise can be reduced as compared with the conventional closed-type compressor using the refrigerant R12 if the residual conditions are the same.

Figure 10:
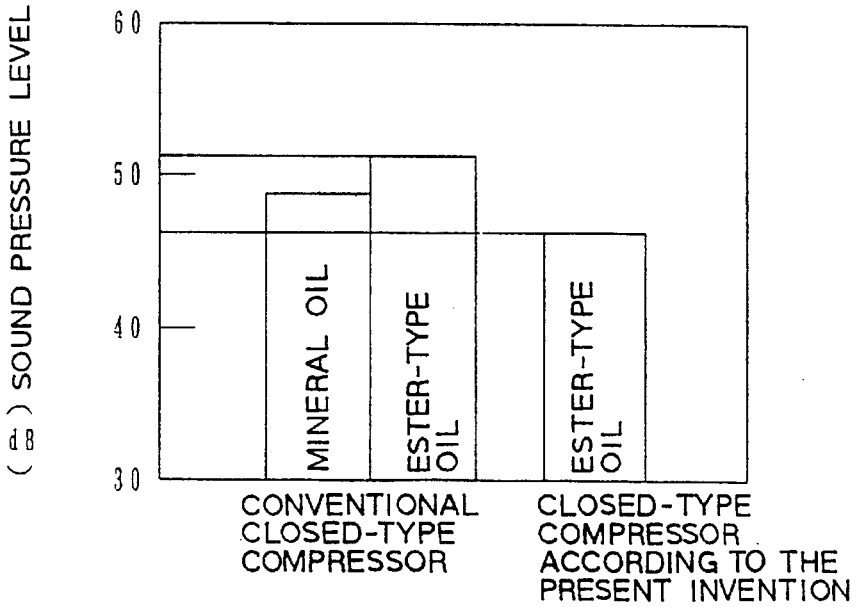
FIG. 10 is a graph showing results of comparison between average noise level in a case where an ester-type oil is used in the closed-type compressor according to the present invention and average noise level in a case where a mineral oil and the ester-type oil are respectively used in the conventional closed-type compressor.

The ester-type oil has a noise transmission efficiency higher than that of the mineral oil employed in the conventional closed-type compressor. Therefore, the use of ester-type lubricating oil in the conventional closed-type compressor will intensify the compressor noise as compared with the compressor noise generated in a case where mineral oil is used as shown in FIG. 10.

However, the closed-type compressor 11 according to the present invention is able to reduce the compressor noise as compared with the conventional closed-type compressor if the ester-type oil is used. The residual conditions are the same.

Although the embodiment of the present invention has employed the refrigerant R134a, which is the HFC refrigerant, as a refrigerant for the compressor, another HFC refrigerant or an HCFC (hydrofluorocarbon) refrigerant may be used in place of the refrigerant R134a.

The other HFC refrigerant is exemplified by difuloromethane (R32), pentafluoroethane (R125), 1,1,2,2-tetrafluoroethane (R134), 1,1,2-trifluoroethane (R143), 1,1,1-trifluoroethane (R143a), 1,1-difluoroethane (R152a) and monofluoroethane (R161), each of which exhibits discharging pressure higher than that of refrigerant R22 as a single refrigerant.

Among the foregoing refrigerants, it is preferable to employ R134, R143 or R143a as a replaceable refrigerant because each of these refrigerants has a boiling point near that of the conventional CFC12 (R12) refrigerant.

The HFC refrigerant may be a mixture of two or more types of HFC refrigerants in place of using the same as a sole refrigerant. The considerable mixed HFC is exemplified by a mixed refrigerant of R125/R143a/R134a, a mixed refrigerant of R32/R134a, a mixed refrigerant of R32/R125 and a mixed refrigerant of R32/R125/R134a.

An HCFC (hydrofluorocarbon) refrigerant may be used in place of the HFC refrigerant. A typical HCFC refrigerant is HCFC22 (R22).

As lubricating oil for use in the closed-type compressor 11, an example has been described in which the ester-type oil is used. A synthesized oil of a type, the main component of which is ester-type oil as a mixed oil of an alkyl benzene type oil and an ester-type oil may be used.

Another embodiment of the closed-type compressor or the present invention will be further described hereunder.

Figure 11:
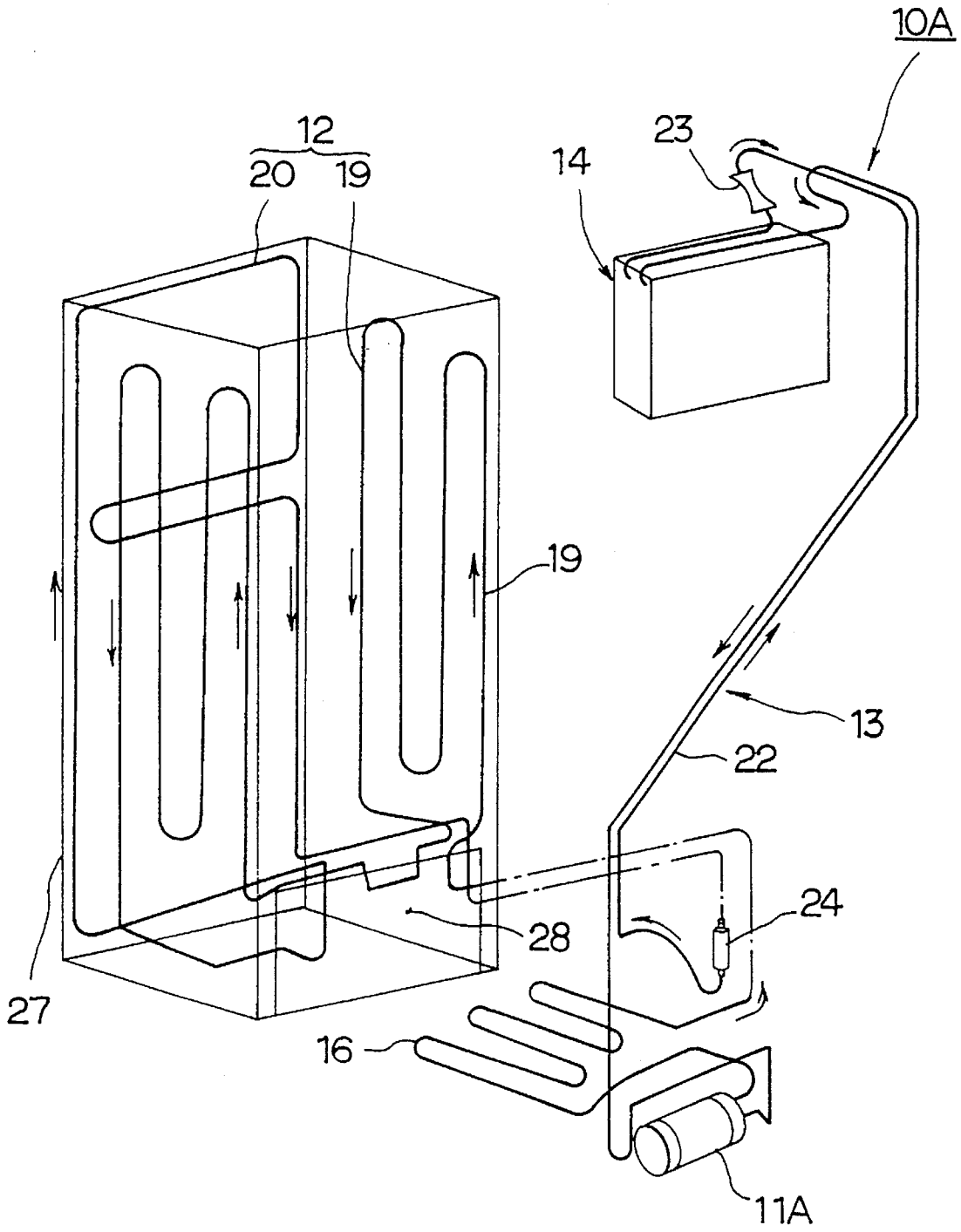
FIG. 11 is a diagram showing another embodiment of a refrigerating cycle of a refrigerator including the closed-type compressor according to the present invention.

FIG. 11 shows an example in which a closed-type compressor 11A according to the present invention is included in a refrigerating cycle 10A of a refrigerator.

Figure 12:
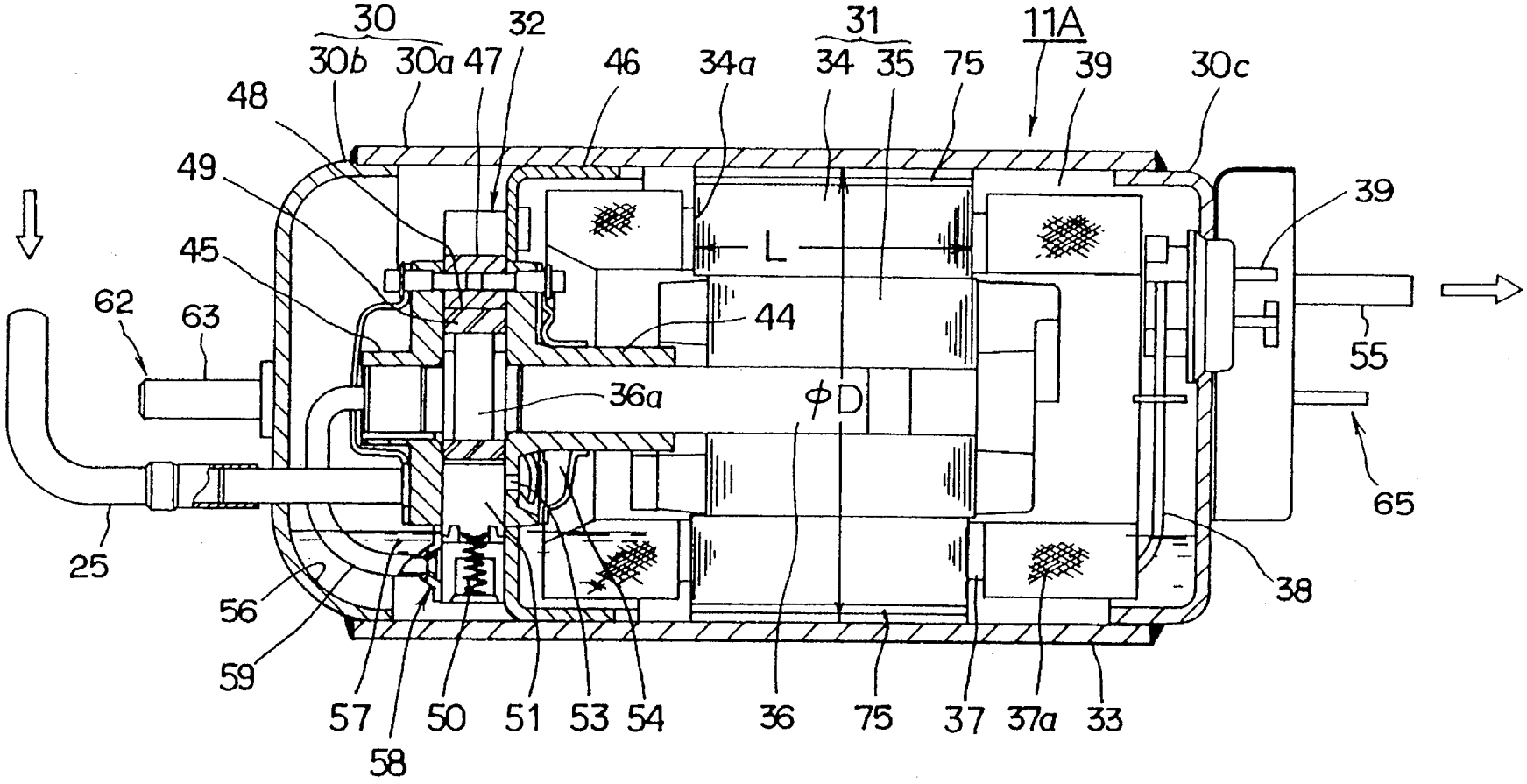
FIG. 12 is a vertical cross sectional view showing another embodiment of the closed-type compressor according to the present invention included in the refrigerating cycle of the refrigerator shown in FIG. 11.

The closed-type compressor 11A to be included in the refrigerating cycle 10A is different from the closed-type compressor 11 of the former embodiment shown in FIG. 4 only in that no oil cooler is disposed in the closed casing 30 as shown in FIG. 12 and the residual structures are not substantially different therefrom. Therefore, the same reference numerals are given and their descriptions are omitted.

Since the oil cooler can be omitted from the closed-type compressor 11A, the evaporating pipe and the sub-condenser can be omitted from the discharge portion of the compressor.

The closed-type compressor 11A comprises the closed casing 30 formed into the three-piece structure comprising a cylindrical body case portion 30*a*, the two-side cover case portions 30*b* and 30*c*. Furthermore, the wall of the body case portion 30*a* is made thicker than that of each of the cover case portions 30*b* and 30*c*. Thus, rigidity of the closed casing 30 can be improved, and therefore, the noise and vibrations of the closed-type compressor 11A can be prevented.

The same portions as those of the closed-type compressor 11 and the refrigerating cycle 10 shown in FIGS. 1 to 4 are given the same reference numerals and their descriptions are omitted here.

Figure 13:
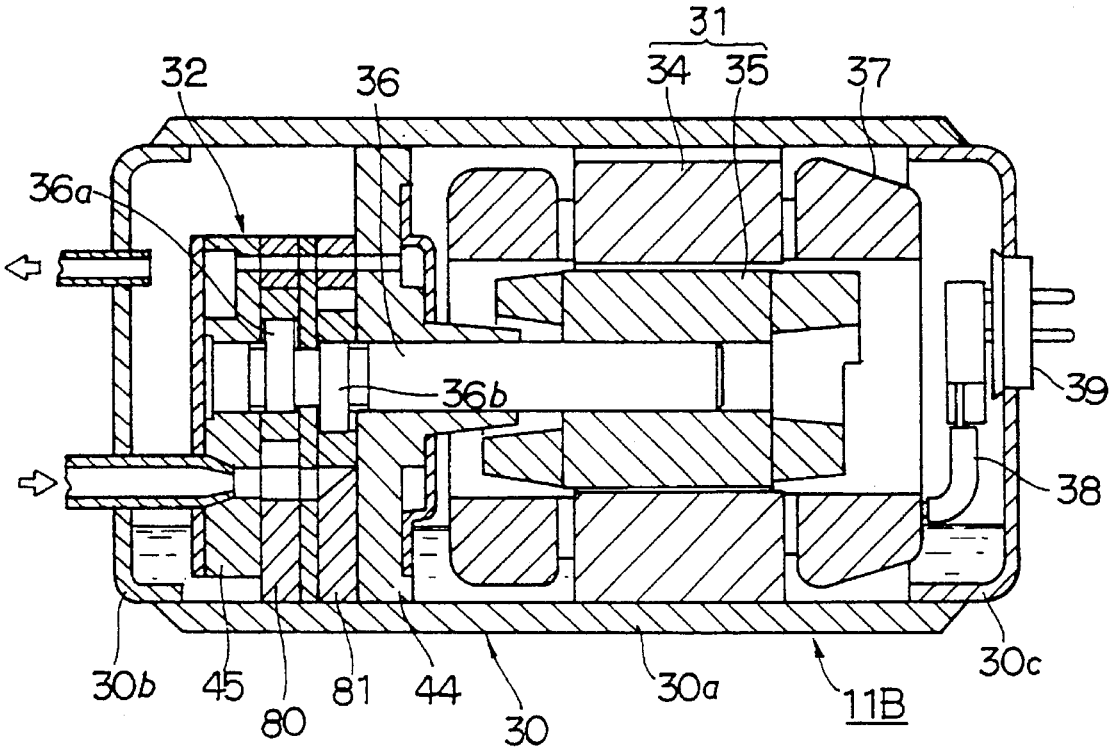
FIG. 13 is a vertical cross sectional view showing a third embodiment of the closed-type compressor according to the present invention.

A closed-type compressor 11B structured as shown in FIG. 13 may be employed as a third embodiment of the present invention. The closed-type compressor 11B has an arrangement in which a motor 31 and a rotary-type compressing machine 32 to be operated by the motor 31 through a rotation shaft 36 are accommodated in a closed casing 30, the rotary-type compressing machine 32 having, for example, two cylinders 80 and 81.

The closed casing 30 for accommodating the motor 31 and the rotary-type compressing machine 32 is formed into the three-piece structure comprising the cylindrical body case portion 30*a*, the two side cover case portions 30*b* and 30*c*. The wall thickness of the body case portion 30*a* is made to be thicker than the wall thickness of the cover case portion 30*b* so that the noise and vibrations of the closed-type compressor 31B are reduced.

The closed-type compressor 11B is formed by combining the closed casing 30 formed into the three-piece structure and the rotary-type compressing machine 32 of the two-cylinder type. The thickening of the body case portion 30*a* improves the rigidity of the closed case 30. Furthermore, the employment of a plurality of cylinders, two 80 and 81 in the illustration, in the rotary-type compressing machine 32 prevents torsion of the crank portions 36*a* and 36*b* of the rotational shaft 36 and improves the rotation balance of the crank portions 36*a* and 36*b*, thus further improving the effect of reducing vibrations. Therefore, the noise can further be reduced as compared with the closed-type compressor 11 accommodating the one-cylinder rotary-type compressing machine 32 although it is formed into the three-piece structure.

Figure 14:
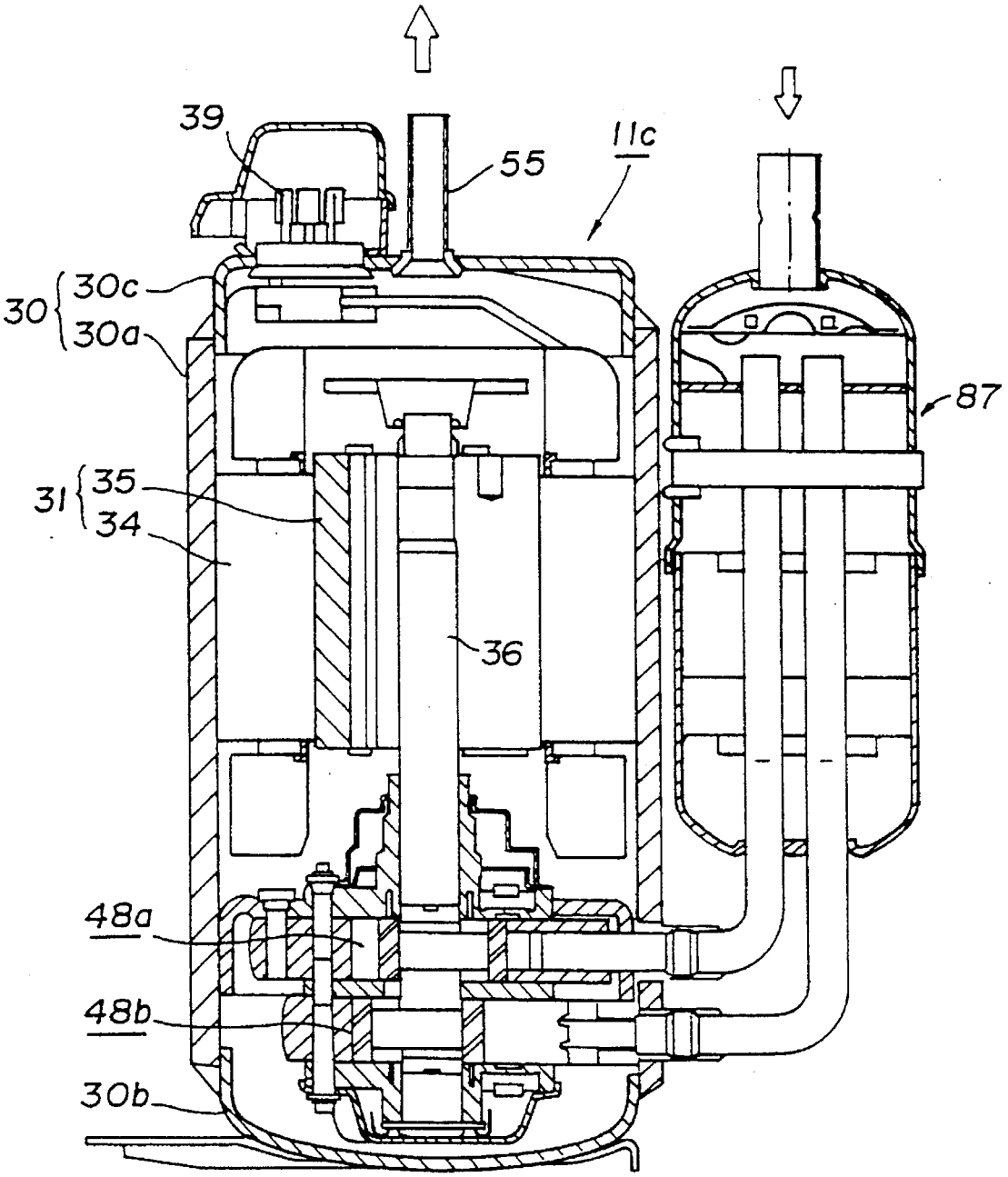
FIG. 14 is a vertical cross sectional view showing a fourth embodiment of the closed-type compressor according to the present invention.

FIG. 14 shows a closed-type compressor 11C according to a fourth embodiment of the present invention.

The closed-type compressor 11C according to this embodiment is included in a refrigerating cycle 10C for an air conditioner for cooling/heating a room.

Figure 15:
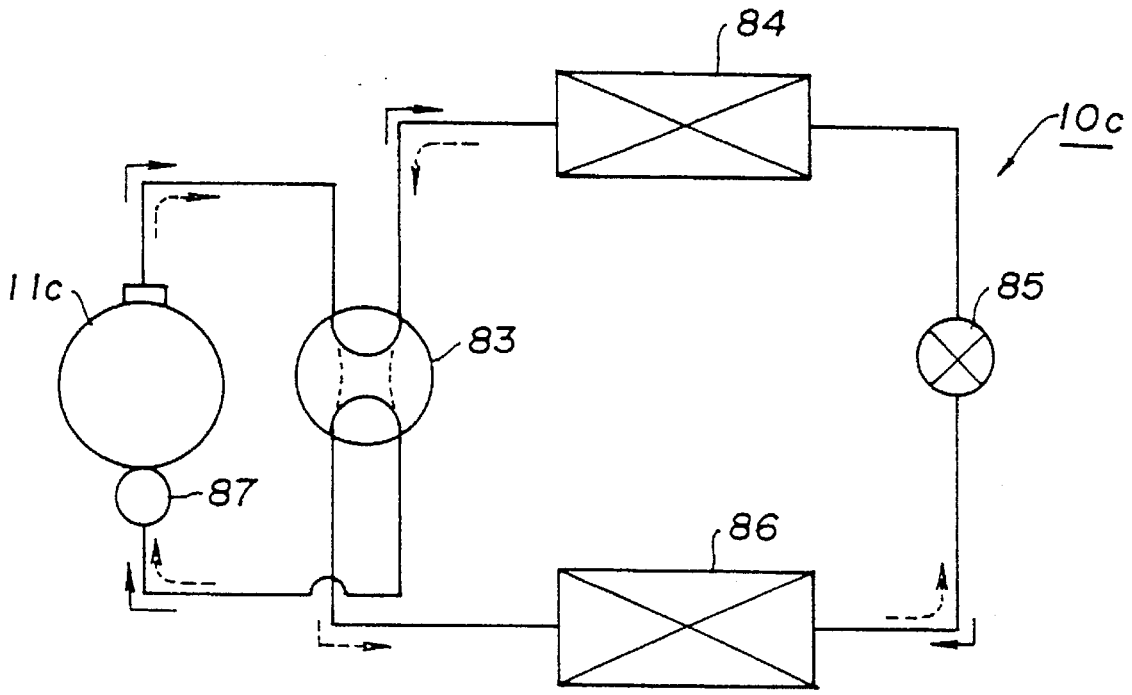
FIG. 15 is a diagram schematically showing the refrigerating cycle of an air conditioner having the closed-type compressor shown in FIG. 14.

The refrigerating cycle 10C, as shown in FIG. 15, forms a refrigerant circulating circuit constituted by sequentially connecting a vertical-type rotary compressor 11C, a four-way-valve switch valve 83, an exterior-side heat exchanger 84, a pressure-reducing unit 85 comprising an expansion valve or a capillary tube and an interior-side heat exchanger 86. Furthermore, the circuit passes through the four-way-valve switch valve 83 and an accumulator 87 and returns to the closed-type compressor 11C.

In the closed-type compressor 11C, the motor 31 is accommodated in the upper portion of the closed casing 30, and the rotary-type compressing machine 32 to be rotated by the motor 31 through the rotation shaft 36 is accommodated in the lower portion of the case. The rotary-type compressing machine 32 is, for example, the two-cylinder type constituted such that two suction pipes extending from the accumulator 87 are connected to respective cylinder chambers 48*a* and 48*b* of the rotary-type compressing machine 32.

On the other hand, the closed case 30 is formed into the three-piece structure comprising the body case portion 30*a*, the cover case portions 30*b* and 30*c* disposed on the two sides of the body case portion 30*a*. The wall thickness of the body case portion 30*a* is made to be thicker than that of each of the cover case portions 30a and 30*b*.

The rigidity of the case can be improved and noise and vibrations of the closed-type compressor 11C can be prevented by forming the body case 30*a* into the thick wall structure.

Figure 16:
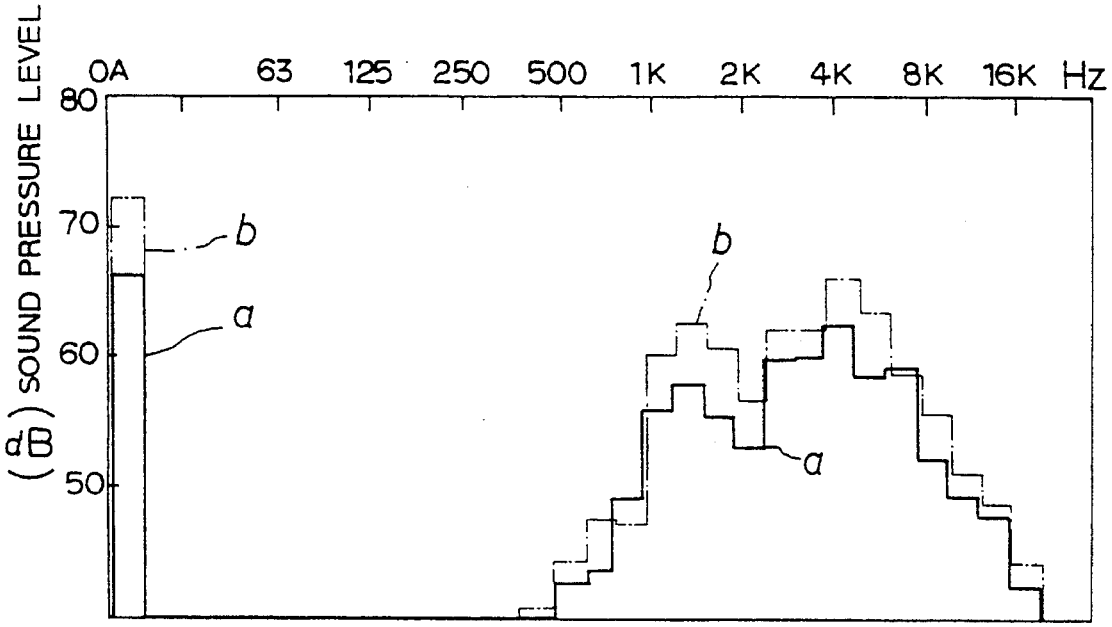
FIG. 16 is a graph showing the results of comparison between average noise level of the closed-type compressor shown in FIG. 15 and the conventional closed-type compressor.
Figure 17:
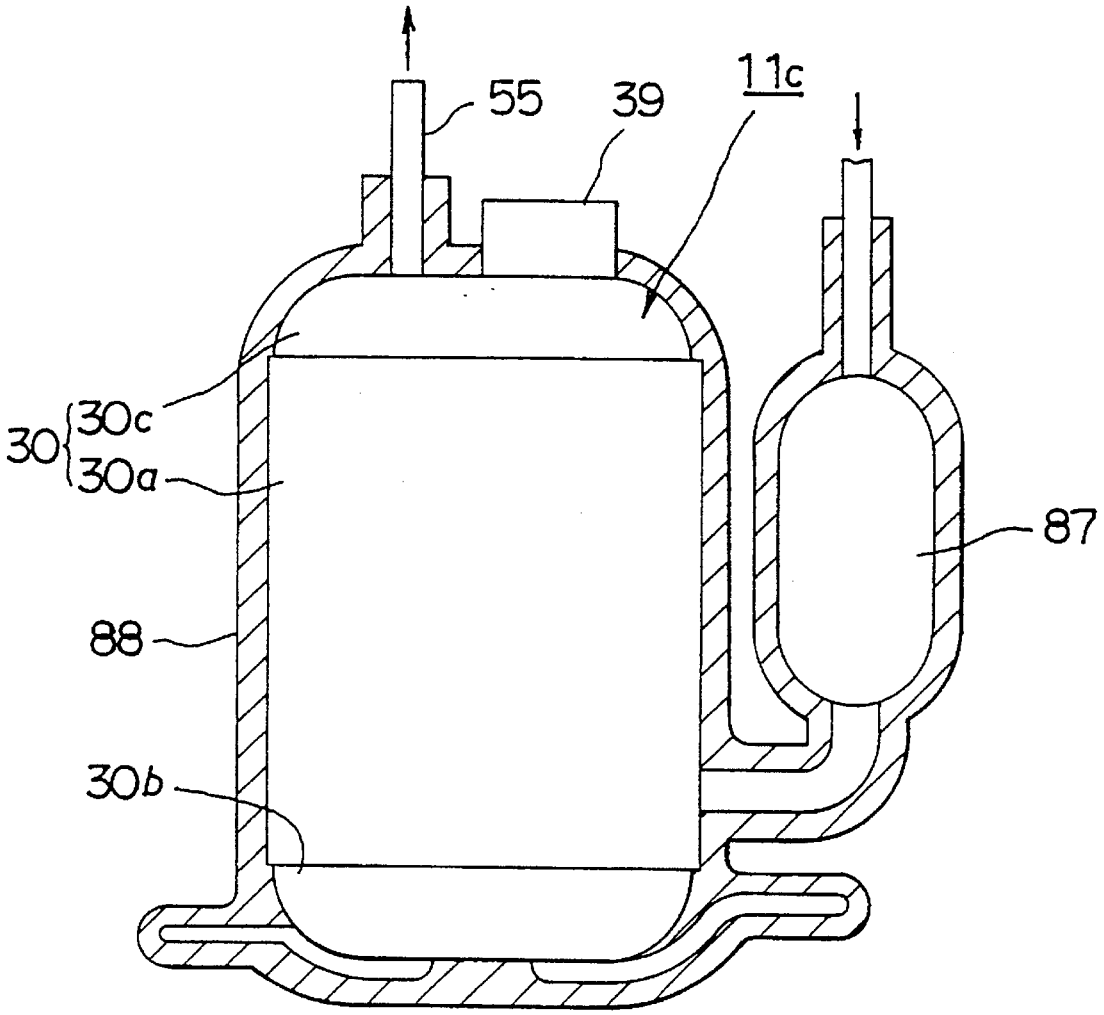
FIG. 17 is a diagram showing a closed-type compressor to which noise prevention countermeasure is taken in the closed-type compressor shown in FIG. 15.
Figure 18:
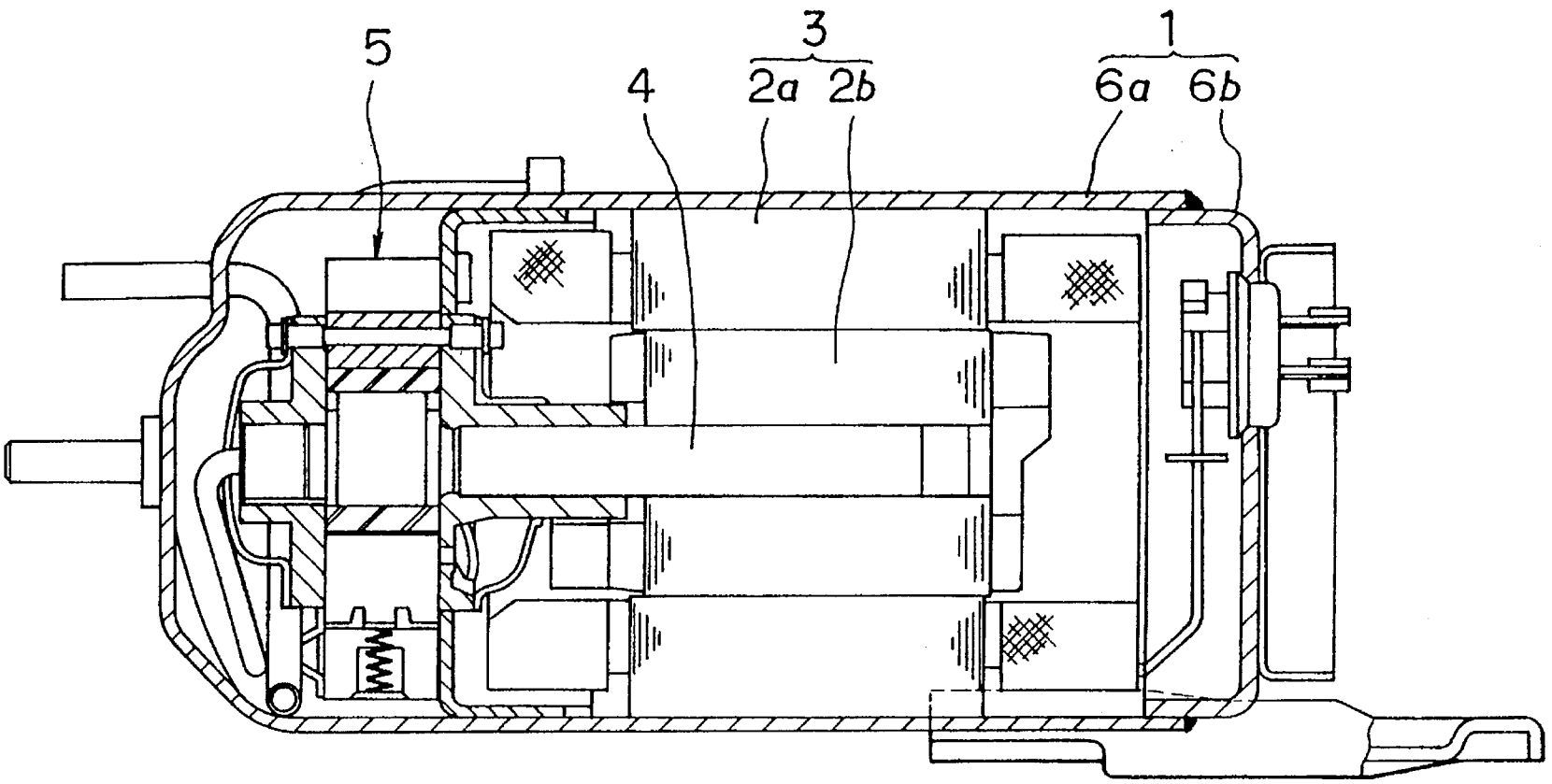
FIG. 18 is a vertical cross sectional view showing a conventional horizontal rotary compressor.

Furthermore, in the closed-type compressor 11C, the closed casing 30 is formed into the three-piece structure to improve the rigidity of the body case portion 30*a* so that vibrations are prevented. The thickening of the wall of the body case portion 30*a* enables noise to be lowered as shown in FIG. 16 such that the sound pressure level in the very low frequency range and that of 500 Hz or higher can be lowered as compared with that of the conventional closed-type compressor designated by the dashed line b.

In the closed-type compressor 11C for an air conditioner, a foaming solution is applied to the outer surface of the closed casing 30 accommodating the motor 31 and the compressing machine 32 and the outer surface of the casing for the accumulator 87. The foaming solution is foamed to cover the outer surface of the casing with foam material 88. Thus, the thickening of the wall of the body case portion 30*a* can be omitted to reduce the noise even if the conventional closed case structure is employed.

The overall body of the closed-type compressor 11C and the accumulator 87 may be covered with a noise-prevention cover made of a noise absorbing material or noise-insulating material.

Although the described embodiments of the present invention each have the structure in which the closed casing of the compressor is formed into the three-piece structure comprising the body case portion and the two side cover case portions, the body case portion 30*a* is molded by rolling a rectangular steel plate and the joint portion is joined by welding, the cylindrical body case portion may be formed by cutting a steel pipe having a predetermined dimensions to have a desired length. It may be molded by extrusion molding or drawing process. In a case where the cylindrical body case portion is molded by cutting the steel pipe or extrusion molding or drawing process, it can be manufactured more easily with lower cost required.

Although the present invention has been described in which the high-pressure-type rotary compressor disposed in the closed case is used as the closed-type compressor, a low-pressure-type rotary compressor may be employed. In place of the rotary compressor, a recitaro-type compressor or another type compressor, for example, a scroll-type or a helical-type compressor may be employed.

Although each embodiment of the closed-type compressor has been described which has the arrangement that the closed-type compressor is included in the refrigerating cycle of a refrigerator or an air conditioner, the closed-type compressor may be included in the refrigerating cycle of a refrigerating unit. The refrigerating cycle of the refrigerating unit basically constitutes a refrigerant circulating circuit formed by sequentially connecting the compressor, the condenser, the pressure-reducing unit and the evaporator in this order. The refrigerating unit is exemplified by a large-size refrigerating machine as well as the refrigerating showcase. In addition, a refrigerating facility can be mounted on a refrigerating car or the like.

The closed-type compressor for use in the air conditioner, the refrigerating unit or the refrigerator employs the closed case structure which is the same as the closed case structure employed in the embodiment. The closed case structure is able to reduce noise without a problem relating to the heat radiation.

As described above, according to the present invention, the closed-type compressor the closed casing is formed into the three-piece structure comprising the cylindrical body case portion and the cover case portions covering the two side openings of the body case portion and the wall thickness of the body case portion is made to be thicker than that of the cover case portions. Therefore, noise transmitted from the motor and the compressing machine in the closed case can effectively be shielded. Furthermore, the rigidity of the body case portion can be improved, and, accordingly, vibrations of the motor and the compressing machine accommodated in the closed case can be reduced. Thus, a low-noise and small-vibration type closed-type compressor can be provided.

Since the closed case of the compressor is formed into the three-piece structure, a deep drawing work is not required to form the two-side cover case portions and thus the quantity of deformation can be reduced. Therefore, it can easily be formed by press work and, accordingly, damage of the cover case portion, such as galling or breakage, can effectively be prevented.

The wall thickness of the body case portion is about 1.25 times to 1.4 times that of the cover case portion. Therefore, compressor noise can be lowered to a level practical for a refrigerator, a refrigerating unit or an air conditioner.

The closed-type compressor may use the HFC (hydrofluorocarbon) refrigerant such as R134a in a single form or a mixed HFC refrigerant or the HCFC (hydrochlorofluorocarbon) such as R22. For example, the HFC refrigerant involves a noise transmission ratio higher than that of the conventional CFC (chlorofluorocarbon) refrigerant. However, the closed-type compressor according to the present invention employs the closed casing of the three-piece structure so that practically quiet characteristics can be obtained even if the HFC refrigerant or the like is used.

The refrigerating unit utilizing the closed-type compressor enables noise to be lowered satisfactorily while eliminating the necessity of improving the noise shielding structure of the machine chamber of the refrigerating unit. Since the necessity of improving the noise shielding structure can be eliminated, the heat radiating effect cannot be affected adversely and a satisfactory countermeasure of the compressor against overheating can be realized.

The refrigerator utilizing the closed-type compressor is able to satisfactorily lower noise while eliminating the necessity of improving the noise shielding structure of the machine chamber of the refrigerator. Further, the heat radiating effect of the compressor is not affected adversely. Therefore, a satisfactory adversely. countermeasure of the compressor against overheating can be realized.

The air conditioner utilizing the closed-type compressor is able to satisfactorily lower noise without the necessity of improving the noise shielding structure of the compressor.

What is claimed is:

1. A closed-type compressor comprising:

a closed casing;

an electric motor accommodated in said closed casing and comprising a stator and a rotor; and a compressing machine operatively connected to said motor to be driven thereby, wherein said stator is provided with a stator core and secured in the closed casing in a state where the stator core is stacked and an axial length of the stator is made longer than a radius of said stator core, wherein said compressing machine has sliding portions to be lubricated and a lubrication oil containing an ester for lubricating the sliding portions, and wherein an HFC refrigerant is used as a refrigerant to be compressed by said compressing machine.

2. A closed-type compressor according to claim 1, wherein the HFC refrigerant is R32, R125, R134a, R143, or R143a, or combination thereof.

3. A refrigerating unit comprising a refrigerating cycle composed by a compressor, a condenser, a pressure-reducing unit and an evaporator operatively connected sequentially, said refrigerating unit including a closed-type compressor for the refrigerating cycle, wherein said closed-type compressor comprises:

a closed casing;

an electric motor accommodated in said closed casing and comprising a stator and a rotor; and a compressing machine operatively connected to said motor to be driven thereby, wherein said stator is provided with a stator core and secured in the closed casing in a state where the stator core is stacked and an axial length of the stator is made longer than a radius of said stator core, wherein said compressing machine has sliding portions to be lubricated and a lubrication oil containing an ester for lubricating the sliding portions, and wherein an HFC refrigerant is used as a refrigerant to be compressed by said compressing machine.

4. A refrigerating unit according to claim 3, wherein the HFC refrigerant is R32, R125, R134a, R143, or R143a, or combination thereof.

5. A refrigerator comprising a refrigerating cycle composed by a compressor, a condenser, a pressure-reducing unit and an evaporator operatively connected sequentially, said refrigerating unit including a closed-type compressor for the refrigerating cycle, wherein said closed-type compressor comprises:

a closed casing;

an electric motor accommodated in said closed casing and comprising a stator and a rotor; and a compressing machine operatively connected to said motor to be driven thereby, wherein said stator is provided with a stator core and secured in the closed casing in a state where the stator core is stacked and an axial length of the stator is made longer than a radius of said stator core, wherein said compressing machine has sliding portions to be lubricated and a lubrication oil containing an ester for lubricating the sliding portions, and wherein an HFC refrigerant is used as a refrigerant to be compressed by said compressing machine.

6. A refrigerator according to claim 5, wherein the HFC refrigerant is R32, R125, R134a, R143, or R143a, or combination thereof.

7. An air conditioner comprising a refrigerating cycle composed by a compressor, a condenser, a pressure-reducing unit and an evaporator operatively connected sequentially, said refrigerating unit including a closed-type compressor for the refrigerating cycle, wherein said closed-type compressor comprises:

a closed casing;

an electric motor accommodated in said closed casing and comprising a stator and a rotor; and a compressing machine operatively connected to said motor to be driven thereby, wherein said stator is provided with a stator core and secured in the closed casing in a state where the stator core is stacked and an axial length of the stator is made longer than a radius of said stator core, wherein said compressing machine has sliding portions to be lubricated and a lubrication oil containing an ester for lubricating the sliding portions, and wherein an HFC refrigerant is used as a refrigerant to be compressed by said compressing machine.

8. An air conditioner according to claim 7, wherein the HFC refrigerant is R32, R125, R134a, R143, or R143a, or combination thereof.

* * * * *